US006478465B1

(12) United States Patent
Thrall

(10) Patent No.: US 6,478,465 B1
(45) **Date of Patent: *Nov. 12, 2002**

(54) MULTIWALL BAG WITH PEELABLE OPENING

(75) Inventor: Ronald G. Thrall, Vancouver, WA (US)

(73) Assignee: Bemis Company, Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/923,041

(22) Filed: Aug. 6, 2001

Related U.S. Application Data

(63) Continuation of application No. 09/434,956, filed on Nov. 5, 1999, now Pat. No. 6,315,448.
(60) Provisional application No. 60/107,954, filed on Nov. 12, 1998.

(51) Int. Cl.[7] ..... B65D 33/00
(52) U.S. Cl. ..... 383/205; 383/86; 383/109; 383/203; 428/40.1; 428/352
(58) Field of Search ..... 383/205, 86, 85, 383/109, 203, 210; 428/40.1, 352

(56) References Cited

U.S. PATENT DOCUMENTS

| | | | | |
|---|---|---|---|---|
| 2,349,247 A | * | 5/1944 | Coghill | 383/210 X |
| 2,998,911 A | | 9/1961 | Hahn et al. | |
| 3,081,930 A | | 3/1963 | Owens | |
| 3,104,798 A | * | 9/1963 | Stone | 383/89 X |
| 3,329,331 A | * | 7/1967 | Morgan | 383/211 X |
| 3,565,328 A | | 2/1971 | Hudson | |
| 3,648,922 A | | 3/1972 | Gebo | |
| 4,441,613 A | | 4/1984 | Hain et al. | |
| 4,460,091 A | | 7/1984 | Hain et al. | |
| 4,480,752 A | | 11/1984 | Jacobs | |
| 4,512,479 A | | 4/1985 | Hain et al. | |
| 4,515,273 A | | 5/1985 | Jacobson et al. | |
| 4,552,269 A | | 11/1985 | Chang | |
| 4,567,987 A | | 2/1986 | Lepisto et al. | |
| 4,584,217 A | * | 4/1986 | McClintock | 428/40 |
| 4,610,651 A | | 9/1986 | Jacobson et al. | |
| 4,616,470 A | | 10/1986 | Nakamura | |
| 4,651,874 A | | 3/1987 | Nakamura | |
| 4,653,250 A | | 3/1987 | Nakamura | |
| 4,739,879 A | | 4/1988 | Nakamura | |
| 4,840,270 A | | 6/1989 | Caputo et al. | |
| 4,871,265 A | * | 10/1989 | Peck | 383/89 |
| 5,048,718 A | | 9/1991 | Nakamura | |
| 5,348,400 A | * | 9/1994 | Haiss et al. | 383/210 |
| 5,582,342 A | | 12/1996 | Jud | |
| 5,888,335 A | * | 3/1999 | Kobe et al. | 156/306.3 |
| 6,048,100 A | * | 4/2000 | Thrall et al. | 383/203 X |
| 6,120,184 A | * | 9/2000 | Laurence et al. | 383/203 X |
| 6,241,390 B1 | * | 6/2001 | Schneck | 383/203 |
| 6,299,355 B1 | * | 10/2001 | Schneck | 383/201 X |
| 6,315,448 B1 | * | 11/2001 | Thrall | 383/203 X |
| 6,325,541 B1 | * | 12/2001 | Thrall et al. | 383/203 |
| 6,328,472 B1 | * | 12/2001 | Laurence et al. | 383/203 X |

FOREIGN PATENT DOCUMENTS

| | | | | |
|---|---|---|---|---|
| CH | 0618934 | * | 8/1980 | 383/85 |
| EP | 0400826 | * | 12/1990 | 383/211 |
| GB | 2216867 A | * | 10/1989 | 383/123 |

OTHER PUBLICATIONS

US 6,068,403, 5/2000, Schneck (withdrawn)*

* cited by examiner

*Primary Examiner*—Jes F. Pascua
(74) *Attorney, Agent, or Firm*—Lee, Mann, Smith, McWilliams, Sweeney & Ohlson

(57) ABSTRACT

A multiwall bag having a fold closeable end combined with a peelable opening assembly adapted to be held within the folded closure, that when opened, provides a pour spout for dispensing of the contents of the package, and optionally, means for reclosing the bag after it has been opened.

8 Claims, 19 Drawing Sheets

MULTIWALL BAG WITH PEELABLE OPENING

PRIORITY CLAIM

This application claims the benefit of provisional application Ser. No. 60/107,954, filed Nov. 12, 1998. This application is a continuation of application Ser. No. 09/434,956, filed Nov. 5, 1999, now U.S. Pat. No. 6,315,448.

BACKGROUND OF THE INVENTION

The invention relates to openings for bags, and particularly to multiwall bags having a pinched closeable end and an opposite closed or open end. The invention is directed to bags of this type having either a flat tube style or with gussets. This type of bag is known in the industry as a pinched bottom open mouth (PBOM) bag. The invention is more particularly directed to providing an easy opening and pour spout-forming manually openable feature at the pinched closed end of the bag. The invention relates to the PBOM type of bag for use in containing granulated or powdered products, such as chemicals, animal feed, dr) milk, and other pourable types of products.

The invention is further related to providing an easy opening tab assembly at the pinched closure which allows multiwall bag making machines to incorporate the tab assembly during machine production of the bags, wherein the tab assembly is positioned to be re fined by the pinched closure to lie flat against the bag when formed.

The present invention is especially directed to use with gusseted multiwall PBOM bags for providing an easy opening, peelable tab assembly permitting the consumer to (1) quickly open a filled and sealed bag and (2) contemporaneously form an easy pouring spout for dispensing the product therein. The invention overcomes deficiencies in the prior art in regard to the manufacturing of such bags, which typically require the unsanitary inclusion of a tear open tab located at least partially inside the bag and folded with the pinched closure between the walls of the bag. Therefore, a goal of the invention is to provide such a tear opening tab assembly that places any adhesive bonding of the tab assembly safely away from the inner contents of the bag, which is of particular concern when a comestible product is within the bag, such as dry milk powder and other flowable granulated type of food materials.

The invention is further aimed at providing a tab assembly that is peelable open the bag and form a pour spout, which may optionally have a recloseable feature that can be manufactured in a manner whereby the peelable opening of the tab assembly remains flush on the face of the bag during the filling, shipping and handling of the bag so as not to be inadvertently caught on machine or handling equipment, which could otherwise rip it off and degrade the bag. This achievement also allows bags to be stacked flat, such as on a pallet, and then easily loaded and unloaded from a truck or the like.

It is also an objective of the invention to provide a tab assembly having a peelable opening tab member that can be manually lifted to tear open the plies of one wall of the bag, but allowing the bag plies of the other wall of the bag to remain intact. It is further a goal of the invention to provide such a tab assembly that may be located either adjacent a comer of the pinched closure or between the corners.

SUMMARY OF THE INVENTION

In general, the invention provides a peelable tab assembly for a bag that is formed with a pinched closeable end and an opposite closed or open end, which bag is filled by the packer with a flowable product, typically granulated or powdered materials, such as pet food, rice, chemical powders, powdered milk and other "dry" commodities. After the pinch closeable bag end is closed, and the bag is then filled, the remaining open end may be closed in the bag-filling line. In the case of flush-cut open ends, they may be sewn or adhesively sealed to closure in a known way. The opposite end may be manufactured in the closed condition, with the pinched closure end left open, leaving it to the packer to make the pinch closure after filling. The invention is also useful for block bottom and satchel bottom bags. Alternatively, beth ends of the bag may be pinch closeable. The tab assembly of the invention is used in cooperation with a standard multi-wall tubular bag usually having two or more plies of paper, and oft n also having an inwardmost plastic ply for sealing the product therein.

The tear open tab assembly incorporates a bag tube having front and back walls. The back wall extends lengthwise a greater distance than the front wall allowing for the folded over pinched closure to be made. The front and back walls may be single plies or multi-plies, typically made of paper, and stepped lengthwise. The pinched closure involves folding over the end portions of the plies of the front and back walls of the bag tube around a fold line space downwardly away from an upper edge of the first wall plies at the same end of the bag. The pinched closure portion of the bag thus is a flap constituted by end portions of the walls of the bag tube at a bag end, which flap is folded over on said fold line that is spaced from the end edge of the front wall at said end. Therefore, the flap comprises the end portions of the front wall ply or plies taken from the fold line to said end edge of the front wall ply or plies, plus a portion of the back wall ply or plies coextensive with said end portion of the front wall, and the extension of the back wall. The peelable tab assembly has a first section that is overlain by a portion of the back wall extension when the pinch closure is completed, but has a contiguous second section that is not overlain by the back wall. The peelable tab assembly first section is adhered between the overlying back wall and the front wall during the pinched closure. The peelable tab assembly first and second sections are commonly bonded to the outer face of the front wall, which bonding is made before making the pinched closure. The first and second sections have a mutually peelable first portion, or portions, that is peeled away from a second portion, or portions, that remains on the bag front wall face to open the bag by means of tearing open the back wall at the pinch closure. The front and back walls of the bag may have side gussets joining them along opposite lateral side edges of the bag or otherwise the bag may be non-gusseted The peelable tab assembly may be arranged adjacent a comer of the bag, where the front and back walls meet at the bag side edge, or otherwise may be provided along the pinch closure intermediate the lateral side edges of the bag. When positioned adjacent the corner of a gussetted bag, the peel tab assembly is arranged to tear a margin along side the gusset adjoining the front wall and form a pour spout. The peelable tab assembly first and second portions are releasably bonded together preferably by means of a pressure sensitive adherent. The peelable tab assembly is initially adhered to the front wall of the bag as one integral unit during bag manufacturing. The pressure sensitive adherent in one embodiment is a tackified adhesive allowing for the first portion of the peel tab assembly to be rebonded to the second portion after being peeled away to tear open the bag. Optionally, the second portion may have an adherent attaching it to the first portion which does not remain tacky. This latter option may be utilized when the nature of the product within the bag usually would require the bag contents to be dispensed in one pouring. Another option is to provide the adherent between the first and second portions to reside on the first portion rather than the second portion.

The first and second portions are laminae forming the peelable tab assembly. They may be single lamina, but either or both can be made of multiple laminae.

DETAILED DESCRIPTION OF THE INVENTION

Figure 2:
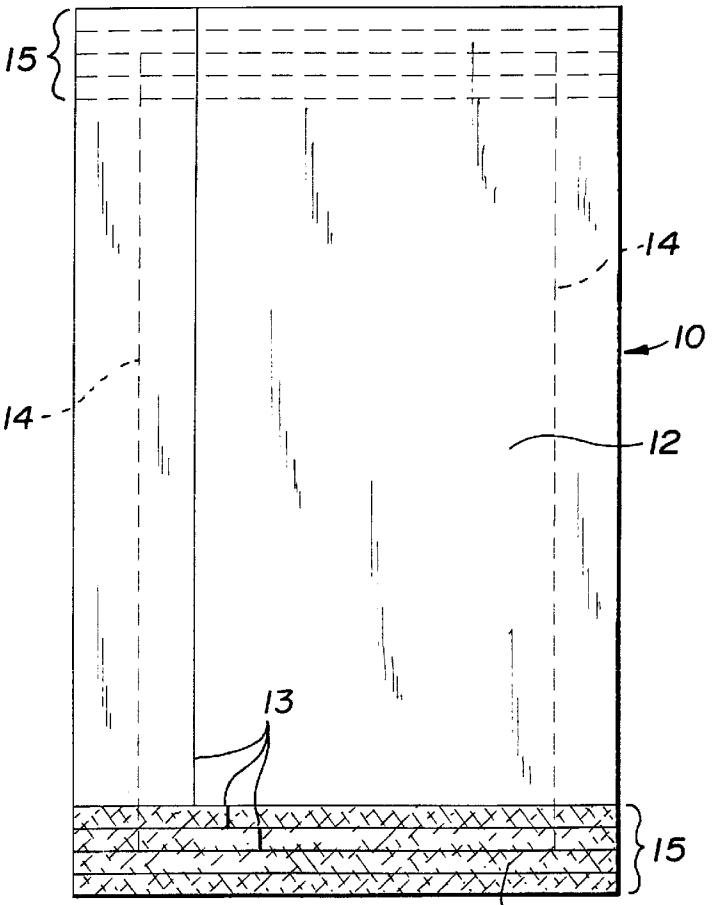
FIG. 2 is an elevation view of the back of the gusseted multiwall paper bag tube of FIG. 1 showing the stepped plies at the upper and lower ends for forming the pitched closures thereat.

With reference to FIGS. 1–21, like reference numerals throughout connote the same elements, the reference numeral 10 is used for all the embodiments of the multiwall bags shown. The invention has use with a folded bag closure, not limited to, but particularly suitable for, a closure in the nature of a pinched closure at one bag end, that is common to all of the bags shown, which bags may also have other features that can be accommodated by the invention.

Figure 1:
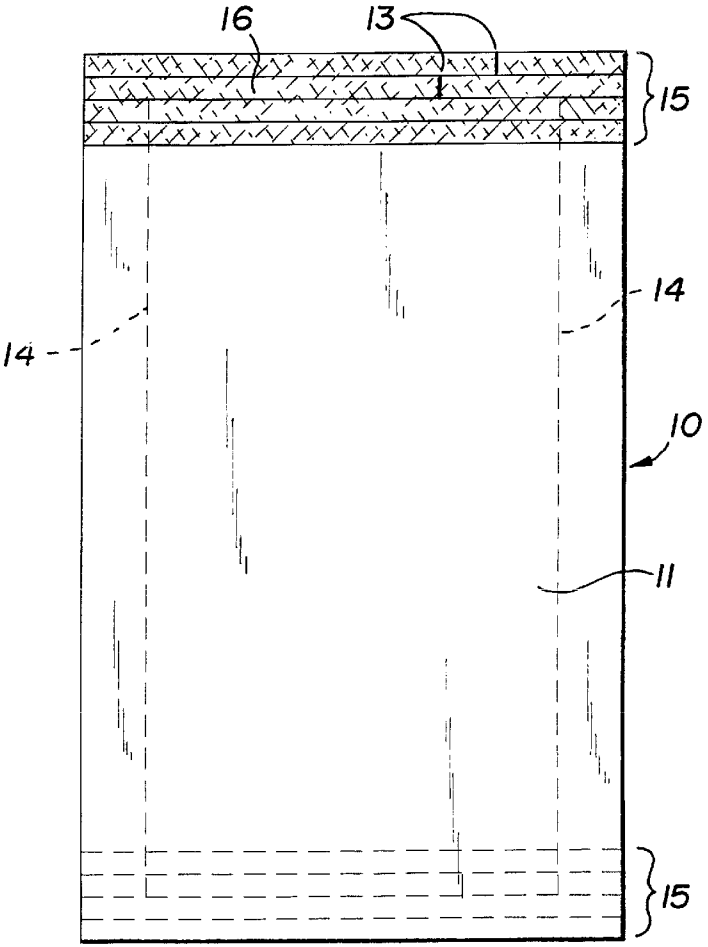
FIG. 1 is an elevation view of the front of a gusseted multiwall paper bag tube having upper and lower ends of front and back walls formed with stepped multiple paper plies to facilitate the making of a pinched closure at either end and further providing for placement of a peelable tab assembly at either end thereof to facilitate easy opening, formation Of a pour spout, and reclosure thereafter.
Figure 4:
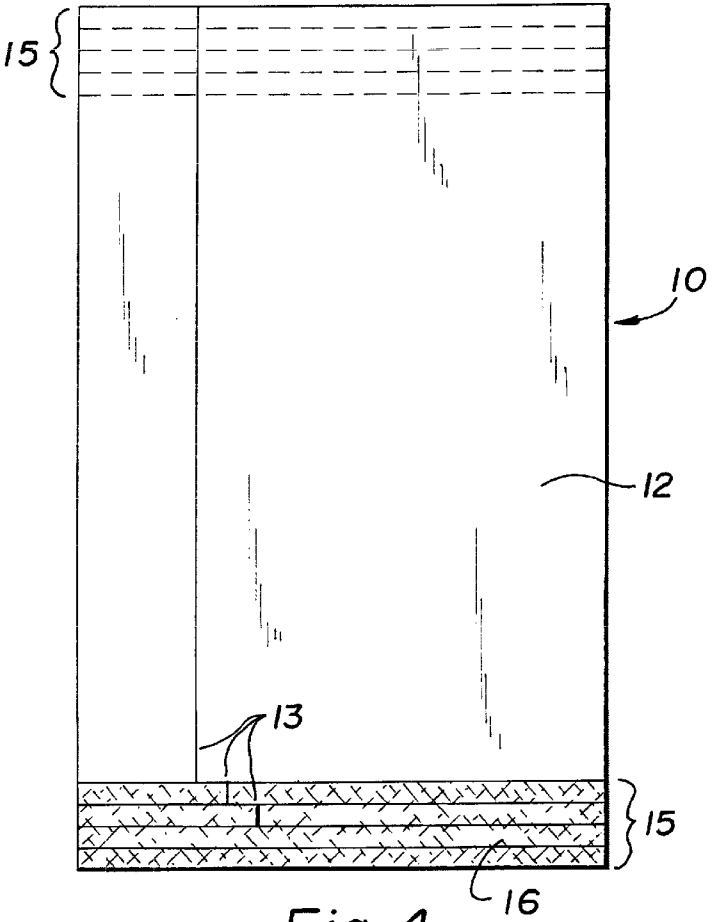
FIG. 4 is an elevation of the back of the non-gusseted multiwall paper bag tube of FIG. 3 showing the stepped plies at the upper and lower ends for forming the pinched closures thereat.
Figure 3:
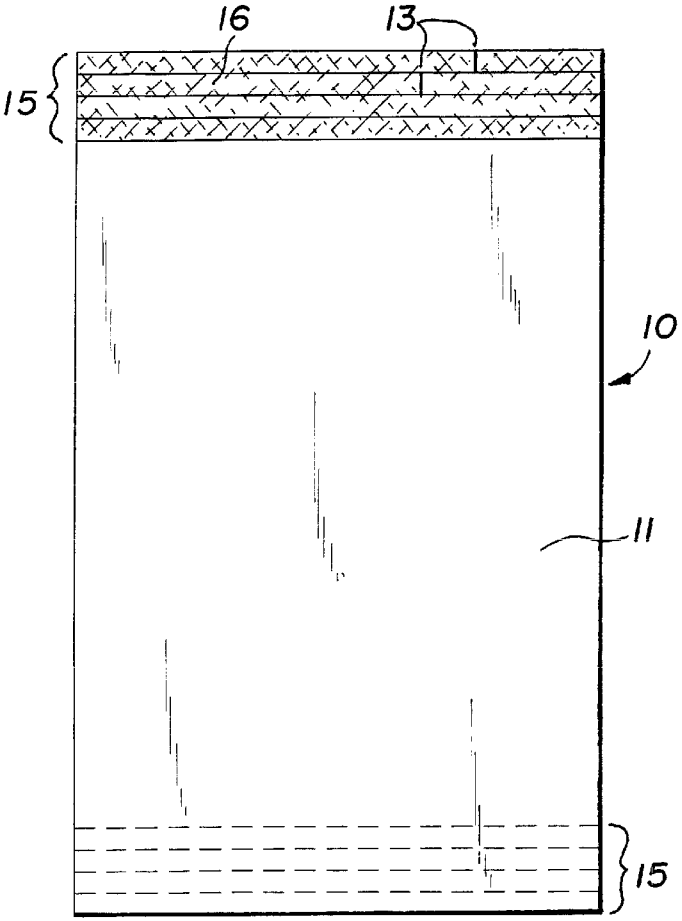
FIG. 3 is an elevation view of the front of a non-gusseted multiwall paper bag tube having upper and lower ends of front and back walls formed with stepped multiple paper plies to facilitate the making of a pinched closure at either end and further providing for placement of a peelable tab assembly at either end thereof to facilitate easy opening, formation of a pour spout, and reclosure thereafter.
Figure 6:
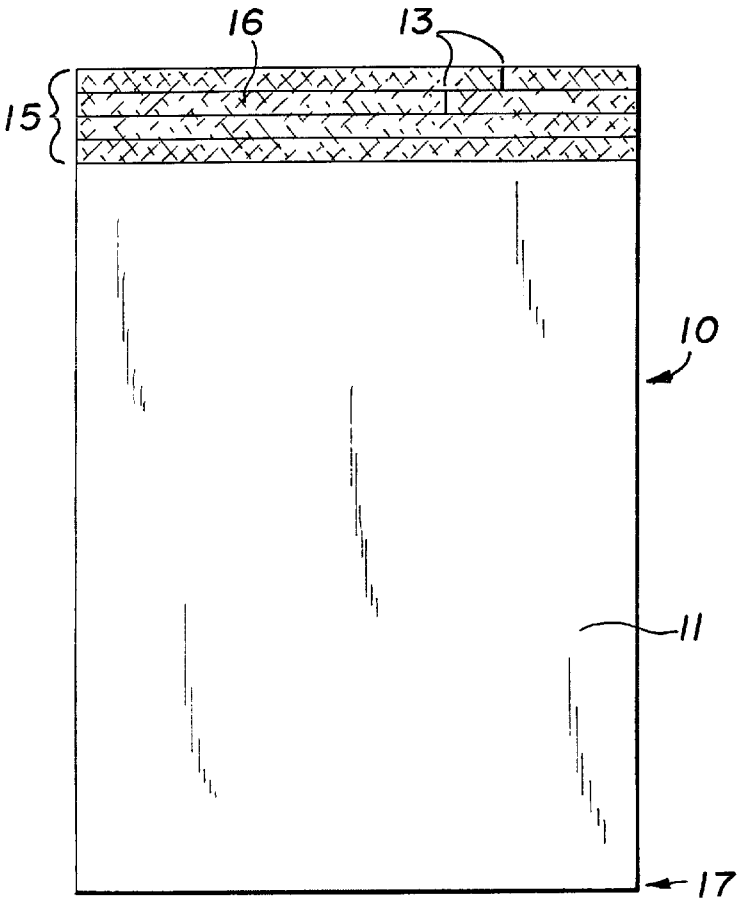
FIG. 6 is an elevation view of the front of a non-gusseted multiwall paper bag tube having one end formed for pinched closure and placement of a peelable tab assembly in accordance with the invention and wherein the other bag end is flush cut for achieving a conventional sewn closure thereat.
Figure 5:
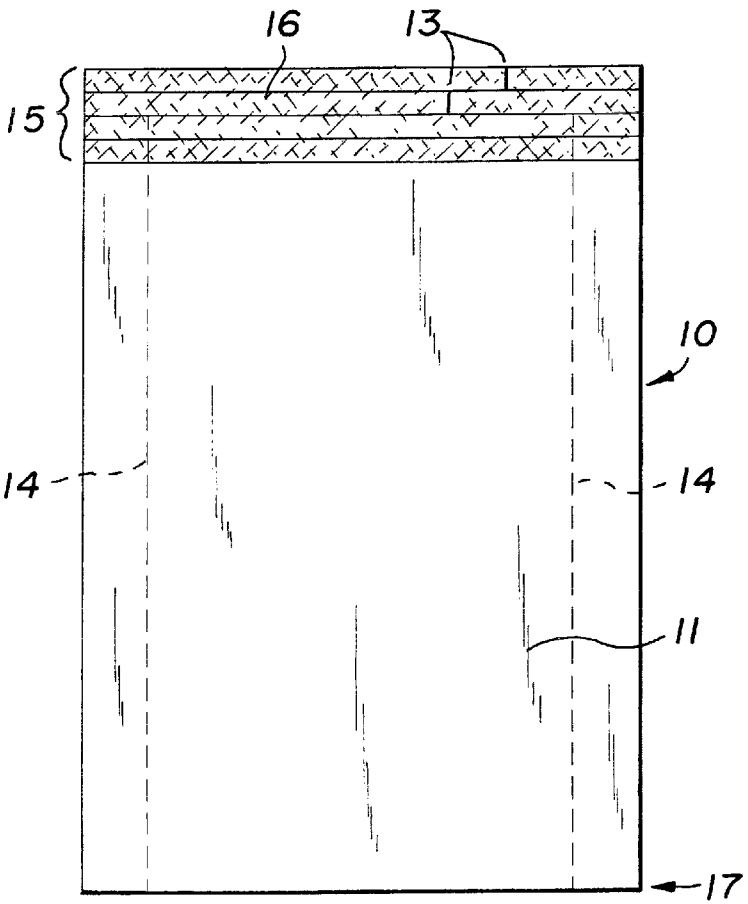
FIG. 5 is an elevation view of the front of a gusseted multiwall paper bag tube having one end formed for pinched closure and placement of a peelable tab assembly in accordance with the invention and wherein the other bag end is flush cut for achieving a conventional sewn closure thereat.
Figure 7:
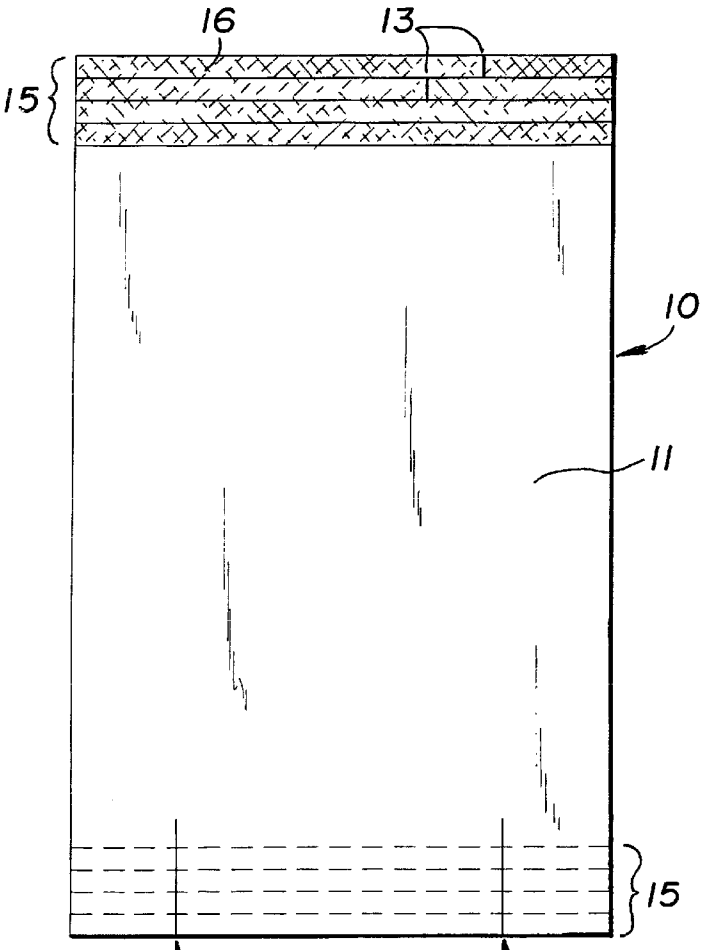
FIG. 7 is an elevation view of the front of a non-gusseted multiwall paper bag tube having one end formed for formation of a pinched closure and placement of a peelable tab assembly in accordance with the invention and wherein the other bag end has stepped plies and vertical slitting thereat in order to achieve a pasted satchel bottom closure known in the industry.

Turning first to FIGS. 1–7, different style bags are disclosed. All have at least one pinch closeable end having stepped plies of paper 15 which are then folded over to form a pinched closure. In the illustrated embodiment, the bags 10 are tubes and have three paper plies. Reference numeral 11 denotes the front walls of the bags and reference numeral 12 designates the back walls, each wall therefore having three ply thicknesses, which are stepped at 15 in order to provide stepped adhesive zones for adhesive to bond the fold over pinch closure, as will be later discussed in regard to FIG. 16. FIGS. 1 and 2 are front and back elevational views of a gusseted multiwall bag 10 having pinched closeable stepped ply ends 15 at both the top and the. bottom. FIGS. 3 and 4 are front and back elevational views of a non-gusseted multiwall bag 10 having pinched closeable stepped ply ends 15 at both ends. FIG. 5 is a front view of a gusseted multiwall bag 10 having a pinched closeable end having said stepped plies 15 at only one end thereof, wherein the other end is flush cut to provide a conventional sewn closure. FIG. 6 is like the bag of FIG. 5 but it is non-gusseted. The bag 10 in FIG. 7 has a pair of parallel slits 18 through the paper plies at one end of the bag for forming a conventional pasted satchel block bottom closure opposite a pinched closeable end. Both ends of the bag have stepped plies 15.

In FIGS. 1–7 the multiwall front and back walls 11 and 12 are also laterally stepped to provide overlapping seams 13 for bonding each ply together in a known way to form a tube. In the Figures, reference numeral 14 at the dashed lines denotes lateral side gussets separating the front and back walls 11 and 12. The stepped ply ends 15 are coated with an adhesive 16, which is normally a hot melt that seals closed the bag pinch closure when folded during manufacturing to the position shown in FIG. 16. A starch based adhesive is another widely-used adhesive, among equivalents, that could be used. In FIGS. 5 and 6, reference number 17 denotes a flush cut end opposite the pinched closeable end at stepped plies 15. The front wall 11 is shown in section in FIGS. 15–17 and bears reference letter F collectively designating the multiple plies forming it and correspondingly reference letter B collectively designates the multiple plies forming the back wall 12. In an optional form of the invention, the innermost ply can be formed of a heat sealable plastic polymeric material when there is a need to sealingly contain chemicals or food products safely from contamination. The invention is directed toward all paper bags and to bags with plastic/poly inner liners.

Figure 8:
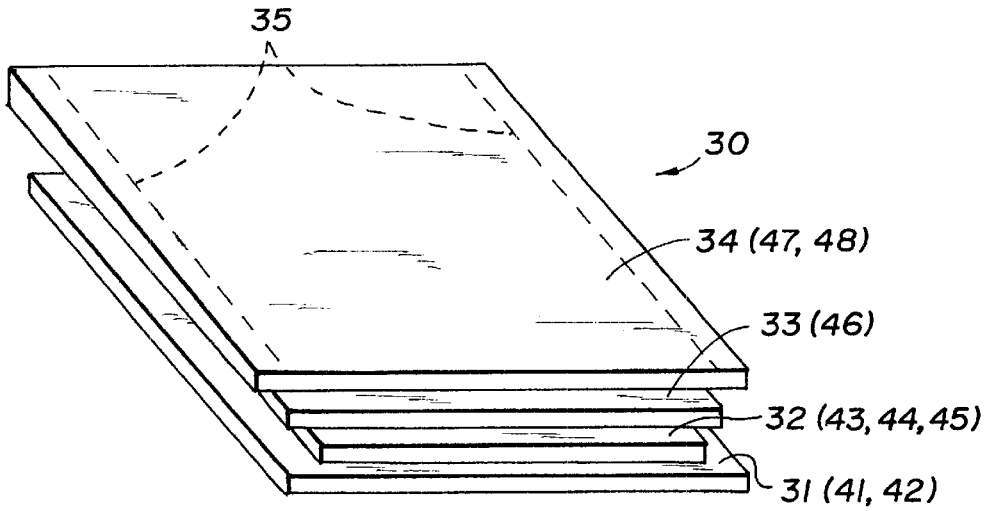
FIG. 8 is a perspective exploded view of the peelable tab assembly of the invention having a multi-layer construction providing a base, bonding section for the base, tab lift section for peel away from the bonding section, and an upper tamper evident layer.
Figure 9:
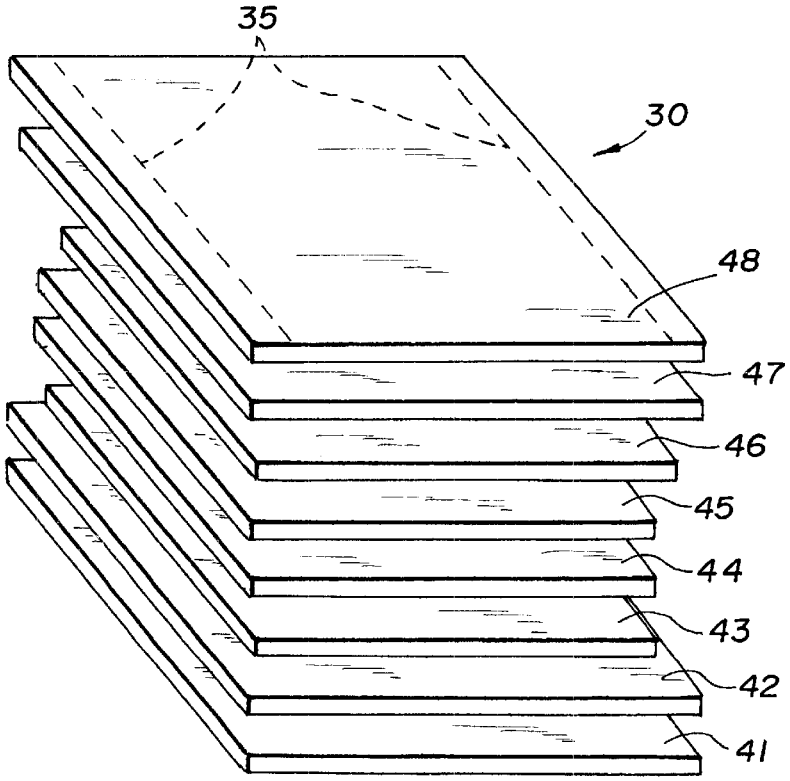
FIG. 9 is a perspective exploded detail view of the multi-layers of the peelable tab assembly as in FIG. 8 showing for purposes of explanation four layers, or zones, of adhesive underneath each of four laminated layers or plies of FIG. 8 comprising the peelable tab assembly.
Figure 11:
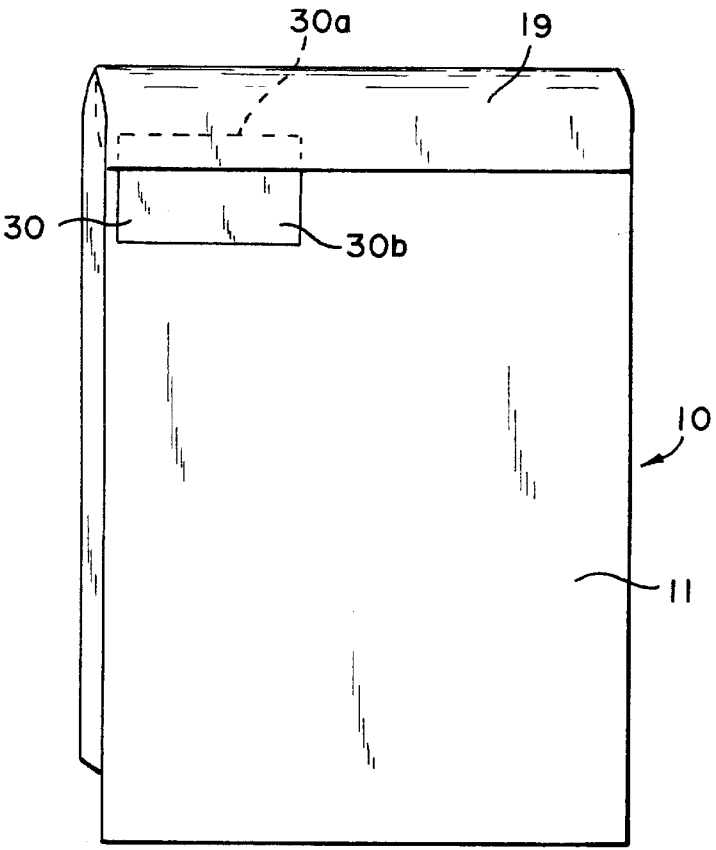
FIGS. 11 and 11A are perspective views of the gusseted multiwall bag tube of FIG. 10 showing the pinched closure completed and wherein the peelable tab assembly is gripped within the pinched closure at a first section thereof and having a second section thereof extending downwardly therefrom and both sections being attached to the front wall face of the bag ready for peel opening, said FIG. 11A including an alternate embodiment having a peel-up flap and construction as found in FIGS. 8A, 9A and 12A–18A.
Figure 10:
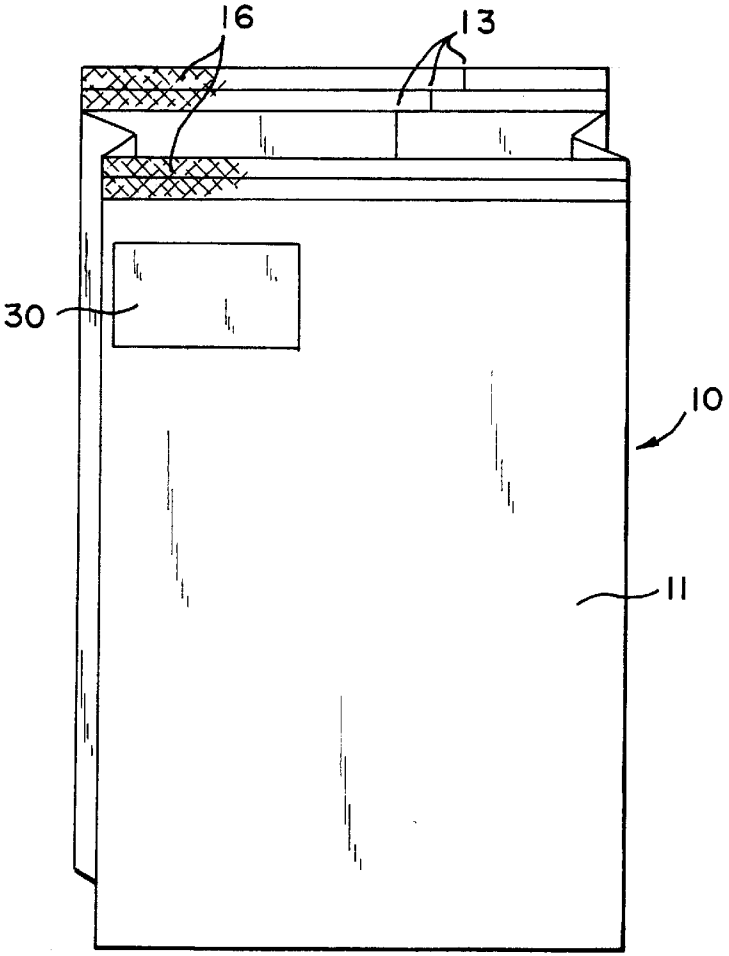
FIGS. 10 and 10A are perspective views of a gusseted multiwall bag tube having an upper open pinch closeable end and showing the placement of the peelable tab assembly of the invention attached to the front wall of the bag in position to be partly retained at a first section thereof within the pinched closure upon folding the front and back walls to make said pinched closure, said FIG. 10A including an alternate embodiment having a peel-up flap and construction as found in FIGS. 8A, 9A and 12A–18A.
Figure 11A:
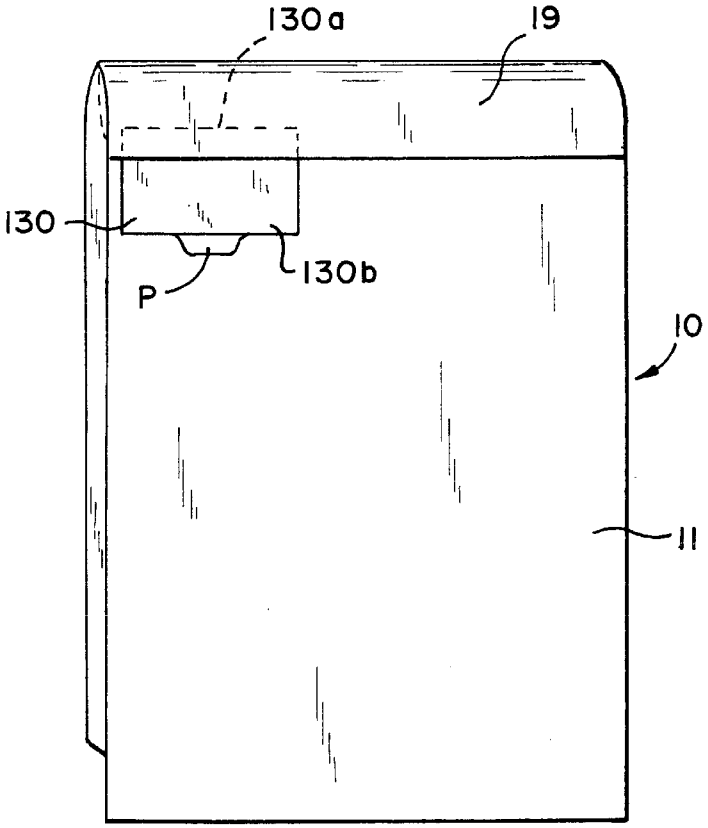

FIGS. 8–11 illustrate the formation of a bag 10 in combination with a peelable tab assembly 30. In the embodiment of FIGS. 10 and 11, the bag 10 has the side gussets 14 which are V-shaped lateral edge portions of the bag 10 joining the front wall 11 to the back wall 12. As the bag 10 is being formed on conventional bag making equipment, after the bag plies have been arranged and the tube formed, the peelable tab assembly 30 is adhered to the front wall 11 in the position shown in FIG. 10. In the embodiment shown in FIG. 11, the pinched closure of the stepped plies 15 is made by the manufacturer whereby a first section 30*a* of the tab assembly 30 is captured and adhered within the pinched closure while leaving a remaining second section 30*b* extending therefrom to be exposed and adhered on the front wall 11. An alternate embodiment involves leaving the pinched closure open, as in FIG. 10, to be sealed later by the packer and complete the pinch closure after the product has been filled into the bag 10. In that way, the opposite bag end could be made in closed or open condition when sold to the customer. The opposite end could be another pinch closeable end, a flush cut end, a satchel end, a block bottom end, or other end closures developed in the bag-making art. In the Figures the peelable tab assembly 30 is illustrated adjacent a corner of the pinched closure 19 but could otherwise be placed between the sides of the bags within the pinched closure 19 in all of these bag configurations. In this alternate a pour spout could not be formed with any side gussets and only a pour opening would be created through the pinch closed end.

Reference is now directed to the exploded perspective view of the peelable tab assembly 30 shown in FIG. 8. In the disclosed embodiment, the peel tab assembly 30 is a peelable multi-laminate that has at least one lamina that is able to be delaminated from the front wall 11 and, in preferred form, re-adherable to afford the consumer a recloseability feature. Reference numerals 31, 32, 33 and 34 are four laminae comprising the multi-laminated peelable tab assembly 30 in the disclosed embodiment. The Figures illustrate a multi-laminate-type product comprising the peel tab assembly 30 (FIGS. 1–18) and an alternate peel tab assembly 130 (FIGS. 8A–18A). The peelable tab assembly 30 is made of a base lamina 31, a bonding lamina 32, a lift lamina 33, which is peelable from the bonding lamina 32, and an uppermost tamper evident lamina 34. The tamper evident lamina 34 is provided with parallel lines of perforation 35 to facilitate tearing at the proper location and also to serve as evidence of tampering should the lift lamina 33 otherwise be removed by vandals or the like. The tamper evident feature may be deleted. The exemplary embodiment thus provides four laminae 31, 32, 33 and 34 however the invention may be practiced with fewer, including providing only the lift lamina 33, or equivalent, adhered by a tackified or non-tackified releasable adhesive layer applied to the front wall 11, as will be further explained below.

Figure 12:
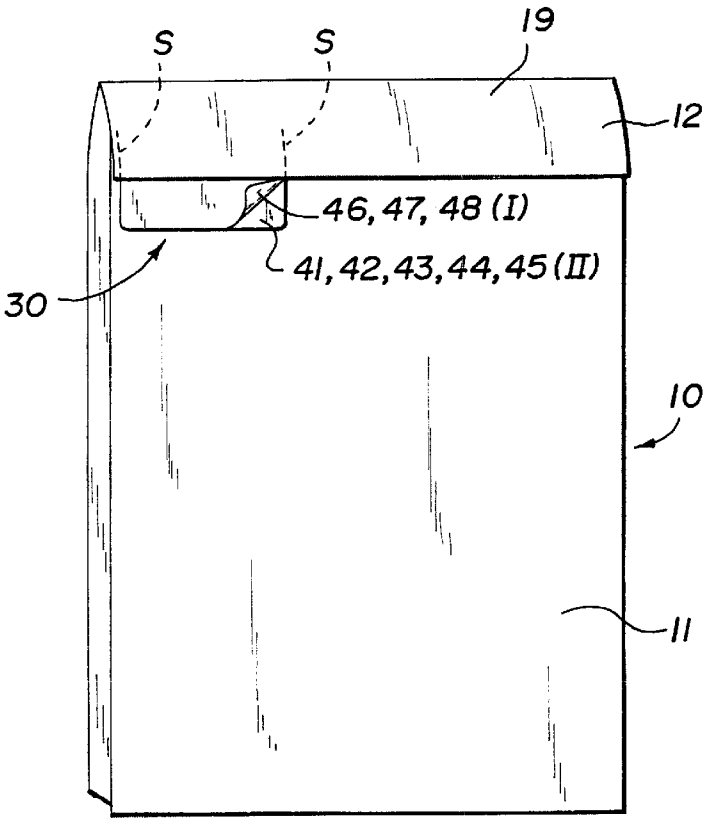
FIG. 12 is a perspective view of the gusseted multiwall bag tube of FIGS. 10 and 11 showing the initiation of the peel opening of the peel tab assembly whereby to peel a first portion away from a second portion remaining on the front wall face of the bag.

With reference to the exploded perspective views in FIGS. 8 and 9 and also with reference to FIG. 12, the multi-laminate construction of the peelable tab assembly 30, including adhesive layers, is shown. In this multi-laminate construction, the base lamina 31 is made of a permanent adhesive 41, such as an acrylic permanent all temperature adhesive, underlying a carrier ply 42, which in the illustrated embodiment is a 60 lb., smooth-coated on one side, super calendered kraft face stock. The permanent adhesive layer 41 bonds the carrier ply 42 to the front wall 11 of the bag 10.

The bonding lamina 32 is comprised of a permanent adhesive layer 43 which in the exemplary embodiment is a hot melt permanent adhesive, a carrier ply layer 44, which comprises a one mil clear polyester (PET) carrier ply, and a hot melt removable, i.e., peelable, adhesive 45. As is seen in FIG. 12, the components 41–45 comprising the laminae 31 and 32 remain on the front wall 11 when the peelable tab assembly 30 is lifted for opening.

Continuing further with reference to FIGS. 8, 9 and 12, the lift lamina 33 is comprised of a five mil polyolefin tag (label) stock 46 in the preferred embodiment and is the separable peeled member that separates from the adhesive 45. This embodiment allows for the recloseability of the lift lamina 33 when folded back onto the adhesive 45 of the bonding lamina 32 by reason of the adhesive 45 being a tackified adhesive. In another embodiment for example when the content of the bag 10 is of the type that is dispensed in one pouring, this adhesive need not be tackified and need not be adapted to be readhered to the lift lamina 33 formed from the tag stock 46.

The tamper evident lamina 34 is comprised of a rubber-based permanent adhesive 47 for securing it to the tag stock 46 which underlies a 50 lb. white uncoated litho paper 48 in the illustrated embodiment. Along the side margins of the tamper evident lamina 34 are the perforations 35 to provide tamper evidence indicating whether the peelable tab assembly 30 is intact The invention is not limited to the multi-laminate configuration of the peelable tab assembly 30 shown in FIGS. 8 and 9 having the component multiple laminae 31–34. To effectuate a recloseable opening, it would be sufficient for the peelable tab assembly 30 to comprise only two components: the adhesive 45 and polyolefin tag stock 46 that forms lift lamina 33, thereby reducing the three-member bonding lamina 32 to only the single member layer of the tackified or untackified adhesive 45. Of course, the invention is not limited to a polyolefin tag stock for the lift lamina 32 and other suitable papers, fabrics, plastics, including polyesters, polypropylene and polystyrene film, metal foils, and the like, may be used. Other peelable adherents suitable for use as adhesive 45 are also useable in the invention for adhering, and optionally, re-adhering to the lamina 35 on one side and adhering to a wall of the bag 10 on the other, including hot melt rubber based adhesives, acrylic, or solvent, based adhesives.

The peel tab assembly 30 can also be used as a label, wherein the lamina 34 may be provided with trademark indicia, product description, consumer information, such as instructions for the peel-openable feature by indicating to the consumer to "lift here," and the like.

Figure 13:
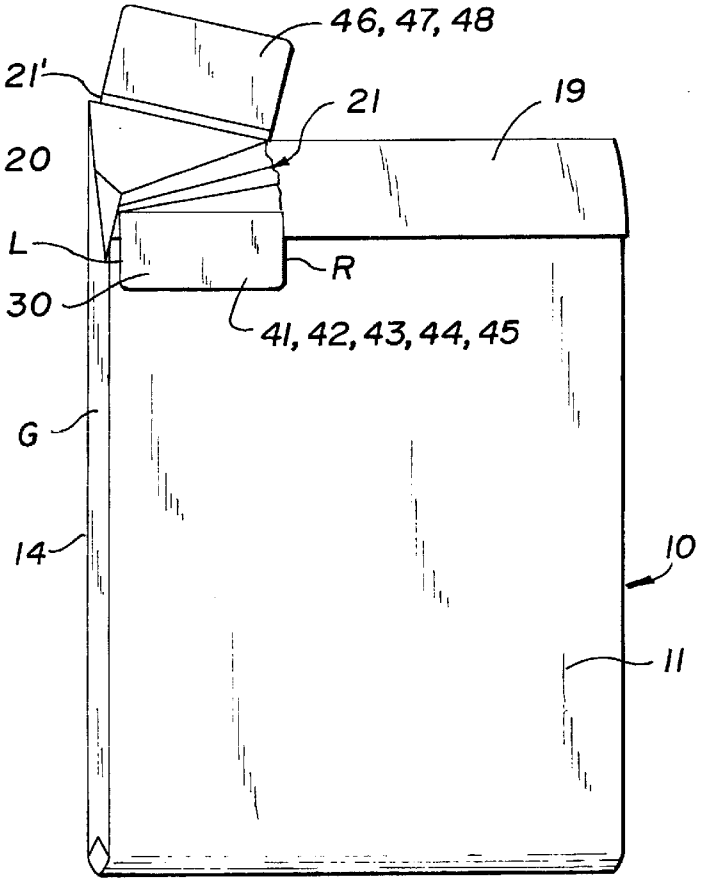
FIG. 13 is a perspective view of the gusseted multiwall bag tube as in FIG. 12 showing the completed peel opening of the peel tab assembly whereby to tear through the back wall of the bag and open the bag to form a pour spout thereat for dispensing a product, wherein the first portion of the peel tab assembly is peeled away from the second portion being retained on the front wall of the bag.
Figure 14A:
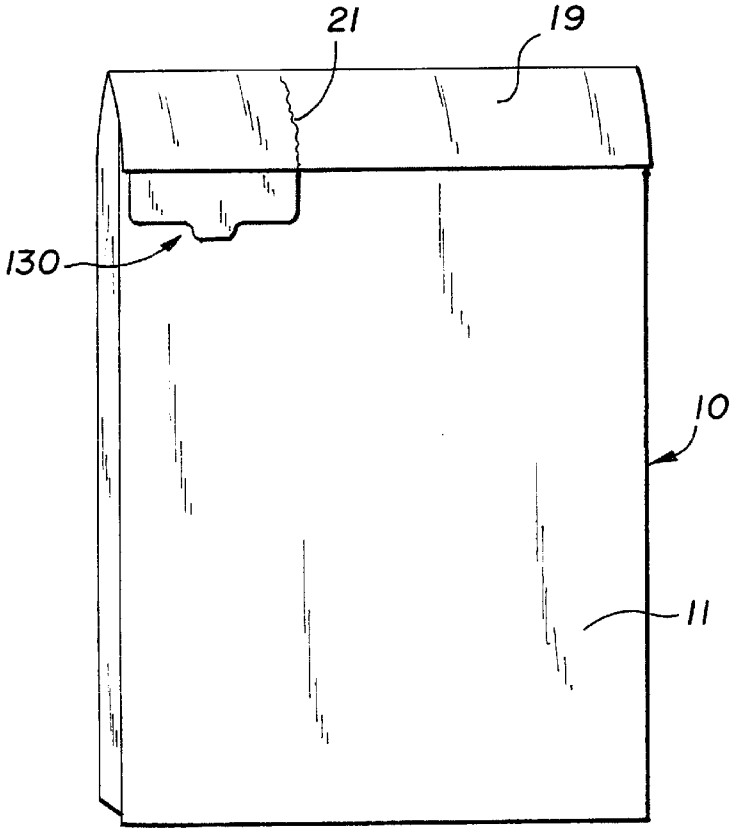
FIG. 14A is a perspective view of the gusseted multiwall bag tube of FIGS. 12A–13A showing the alternate embodiment of the peel tab assembly reclosed and further illustrating a tear line through the back wall created by peeling open the peel tab assembly.
Figure 14:
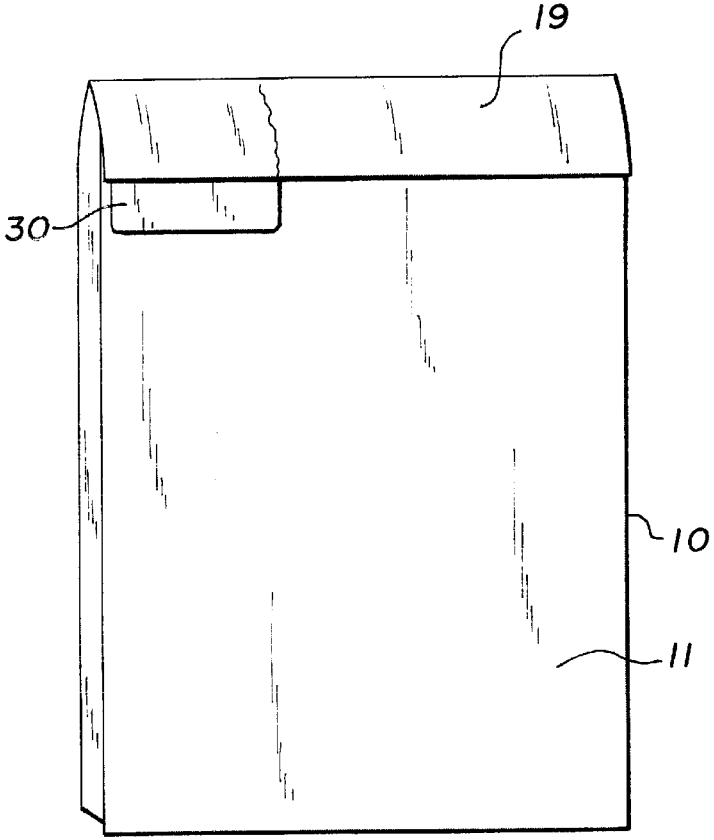
FIG. 14 is a perspective view of the gusseted multiwall bag of FIGS. 10–13 showing the peel tab assembly reclosed and further illustrating a tear line through the back wall created by peeling open the peel tab assembly.

With reference to FIGS. 12–14, Roman numeral I designates the components 46–48 that comprise the peel-up first portion of the peelable tab assembly 30 and elements 41–45 are referenced by Roman numeral II indicating that they comprise the second portion which remains on the front wall 11. Therefore it will be understood that the peelable tab assembly 30 comprises the first portion I that is peeled away and tears through the pinched closure 19 and the second portion II that stays attached on the front wall 11 and also allows for recloseability onto the tackified hot melt removable adhesive 45 in the preferred embodiment shown in FIG. 14.

In another embodiment of the invention, the hot melt removable adhesive 45 may be provided on the underside of the lift lamina 33 to be carried on it when peeled up. That way, the bonding lamina 32 would consist of only the permanent adhesive 43 and the carrier ply 44. This option is most suitable where recloseability is not required and thus the adhesive 45 would not be re-adherable.

As the first portion I of the peelable tab assembly 30 is lifted, a tearing of the pinched closure is aided by means of parallel perforated slits S which are generally co-linear with the perforations 35 or the side edges of the lift lamina 33. The slits S in the disclosed embodiment are provided on the two innermost inner plies. Thus, if a poly liner were used, it and one paper ply would be slit. The slits S facilitate the first portion I to be readily moved upwardly to tear through the pinched closure 19 along the folded over back wall 12 portion that is folded over the front wall 11, which results in jagged tears 21 and 21' shown in FIG. 13. The tear 21 is a tear in the pinched closure 19 by delaminating the first portion I from the second portion II. Likewise, the tear 21' is a resulting rip through the pinched closure 19 adjacent the gusset 14 at the top corner of the bag. In the illustrative embodiment the slits S are about four inches apart and the slit S adjacent the gusset 14 is made about ¼–1/2 inch inward of the bag edge within the gusset 14. A resulting pour spout 20 is formed which has a generally triangular shape when looking downwardly thereon, wherein the base of the triangle is the outward unfolded gusset 14 and the two triangle legs being portions of the front wall 11 and back wall 12 generally between the slits S. If the peel tab assembly 30 were not adjacent a bag comer so that both slits S would be made inward of the gusset 14, a pour spout would not be formed and only a pour opening through the pinch closure 19 would result.

Figure 15:
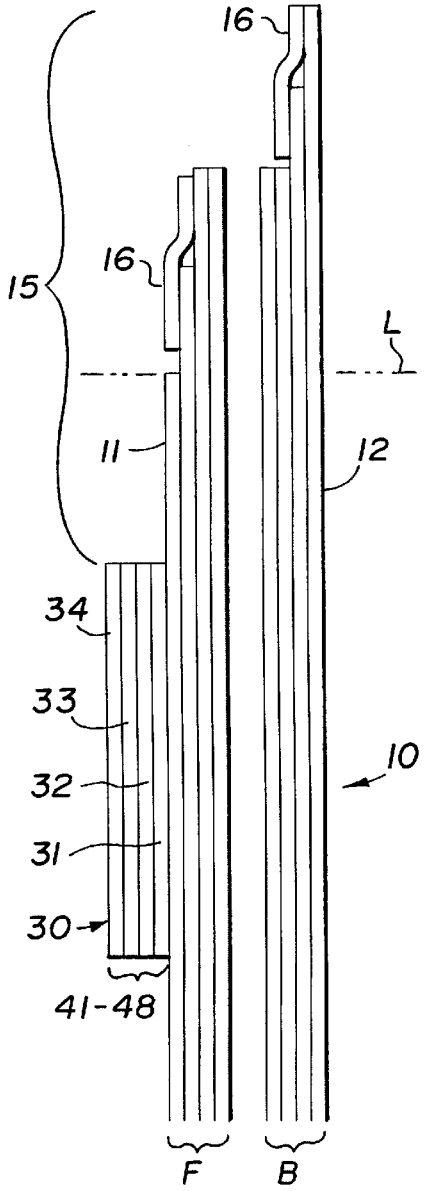
FIG. 15 is a vertical section taken through the peel tab assembly of the gusseted multiwall bag as shown in FIG. 10 showing the pinched closeable open end, the multi-ply front and back walls of the bag, and the peel tab assembly adhered to the face of the front wall.
Figure 16:
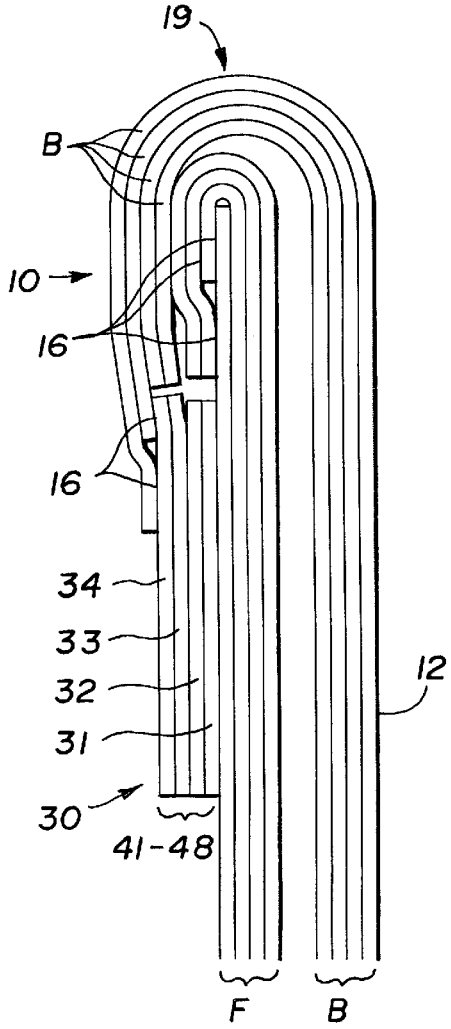
FIG. 16 is a vertical section taken through the peel tab assembly of FIG. 11 illustrating the gripping of the first section of the peel tab assembly at the pinched closure by means of being overlain by and adhered to the folded-over back wall of the gusseted multiwall ba.
Figure 17:
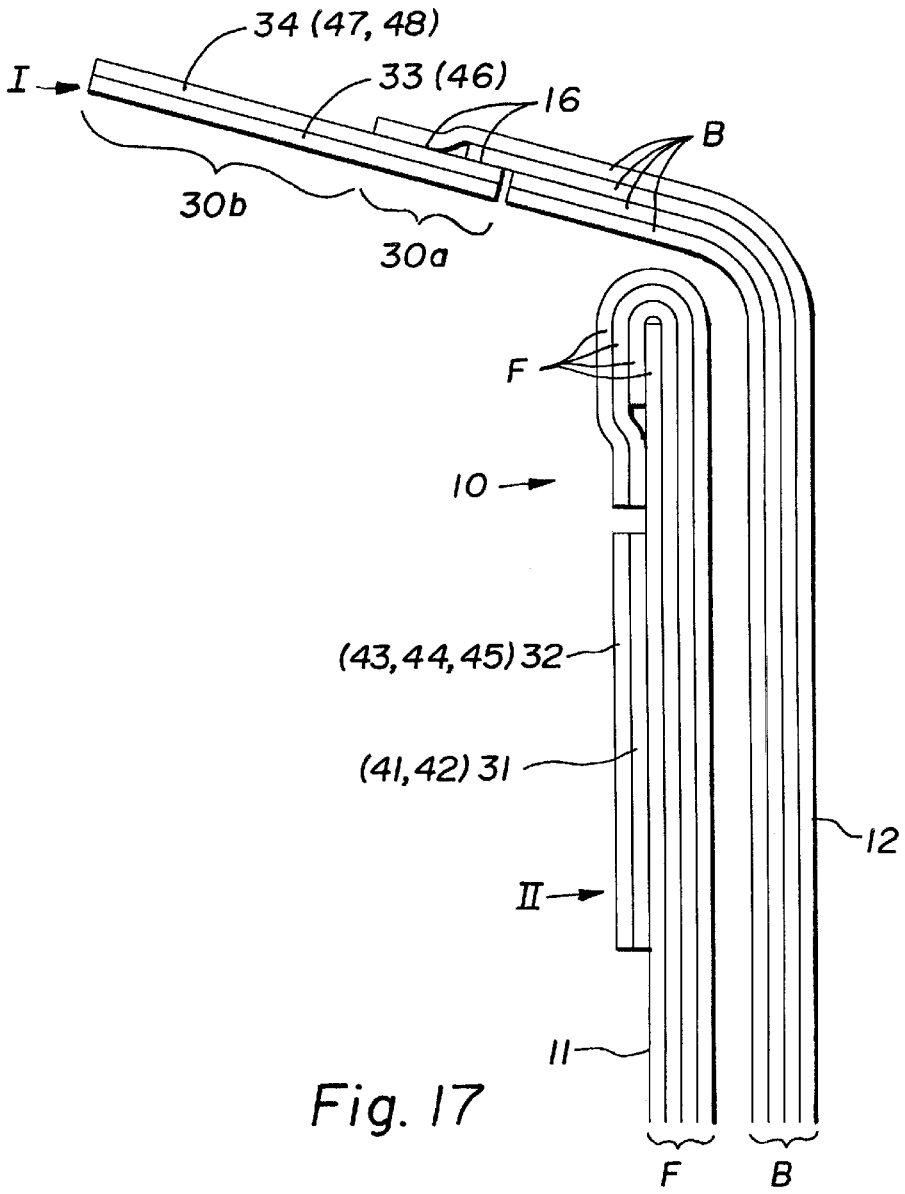
FIG. 17 is a vertical section taken through the peel tab assembly and showing the peel away opening of the peel tab assembly wherein the first portion of the peel tab assembly is lifted upwardly with a part of the back wall and the second portion is retained on the face of the front wall of the bag as in FIG. 13.

Turning to the cross sectional views in FIGS. 15–17, it will be understood that the peel tab assembly 30 is spaced downwardly along the front wall 11 below the pinched closeable stepped plies 15, which form an upper fold-over tab for facilitating the pinched closure 19. With reference to the front elevation view of FIG. 1 in combination with FIG. 16, it ill be seen that the adhesive 16 is coated on the upper ends of the stepped plies 15 across the bag width. During closure, the ends of the back wall 12 plies B are pivoted toward the front wall 11 plies F around a fold line L to result in the pinched closure configuration as in FIG. 16. Preferably the adhesive 16 is a hot melt whereupon making the fold, heat is applied while the closure 19 is being held by the bag closing pinch apparatus in a typical pinch closing method known in the industry. In the disclosed embodiment, only the outermost ply and next adjacent second ply of the plies B of the back wall 12 are adhered by adhesive 16 to the peel tab assembly 30 at the first section 30*a* under the back wall 12 (FIG. 16), thus leaving the second section 30*b* exposed and the first section 30*a* underneath these two plies of the folded over plies B of the wall 12. It will be understood that all of the plies B of the back wall 12 are bonded together. Thus, when the first portion I is lifted, and the lift lamina 33 tears through the pinched closure 19, t he portion I pulls up all of the plies B of the back wall 12 between the slits S. This tearing action however leaves the folded over upper portions of front wall plies F in a folded-over uninterrupted condition, remaining adhered together by the adhesive 16, and spaced above the second portion II of the peel tab assembly 30 that remains on the front wall 11. This peel opening action results in the creation of said spout 20. When providing the tackified-type of re-adherable adhesive for the adhesive layer 45, the first portion I may be repivoted from the condition in FIG. 17 to that shown in FIG. 16 thereby remating lift lamina 33 onto bonding lamina 32.

As noted above, the tearing open of the pinched closure 19 is achieved by tearing through only the plies B of the back wall 12 of the bag 10 while leaving unaffected the front wall plies F forming the front wall 11. Some or all of the back wall plies B may be adhered to the overlain first section 30*a* of the peelable tab assembly 30, but all of the plies B of the back wall 12 are pulled away and torn between the tears 21 and 21 ' in order to open the bag 10.

Figure 18:
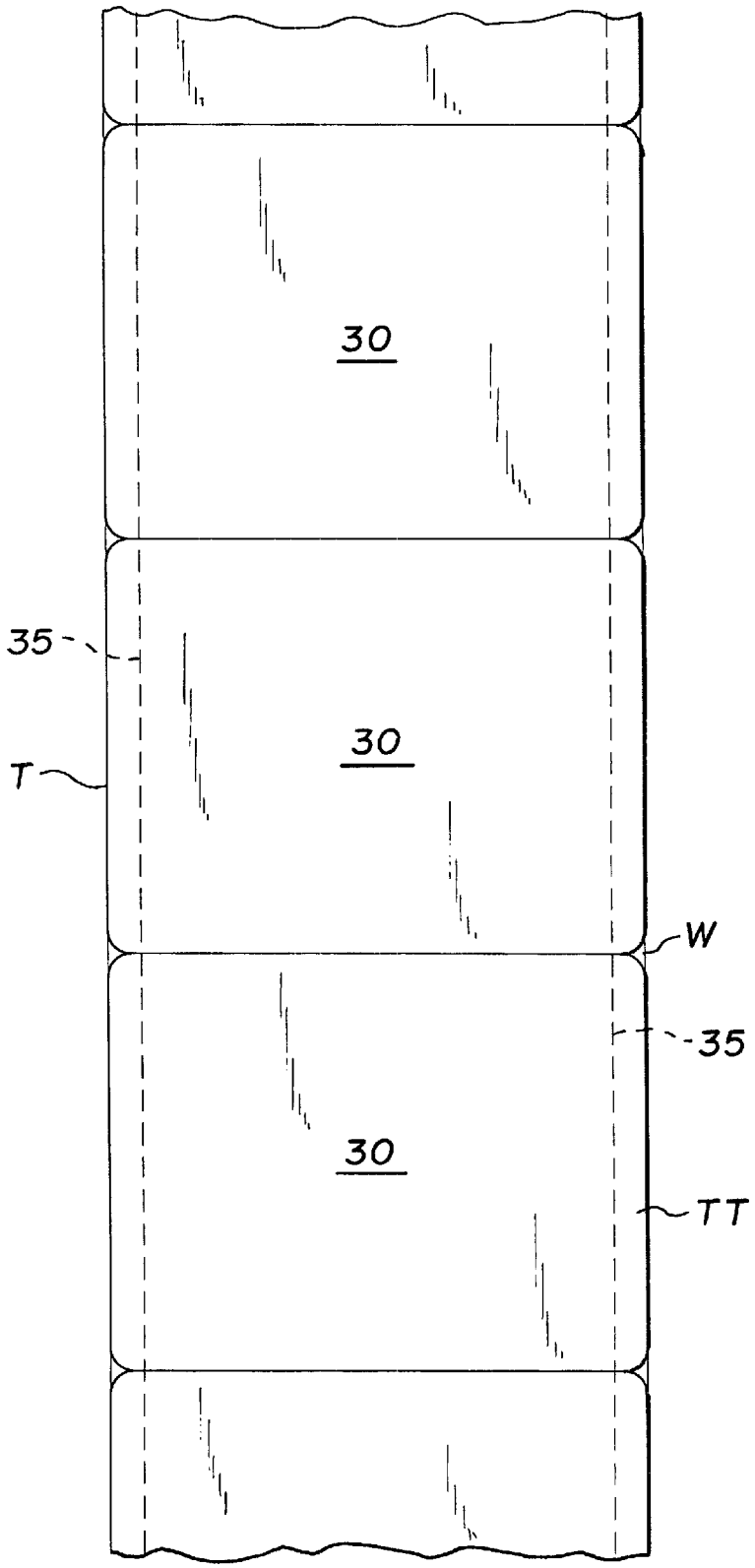
FIG. 18 is a plan view of a continuous web of peel tab assemblies in one embodiment of the invention which peel tab assemblies are individually severed and fed into bag forming equipment for placement on the front wall face of the bag as in FIG. 10 during bag manufacturing.

In FIG. 18, a sequence of separable peelable tab assemblies 30 is shown, which could be made by a label manufacturer. The assemblies 30 are on a release liner comprising a web W, which is typically a release-type paper, such as 40–50 pound kraft stock, allowing the assemblies 30 to be removed to thereby expose the underside permanent adhesive layer 41, whereupon a bag manufacturer would then place the assemblies 30 on sequentially made bags in the position on the bags as shown in FIG. 10 during bag manufacturing. In the disclosed embodiment, the tab assembly 30 is three inches long and four inches in width across the face of the bag. Typically, this size would be used for a multiwall bag, such as used for dog or cat food which would contain a granulated product in the range of from about 10 to 20 pounds. Of course, the invention is not limited to any particular size bag and the length and width of the peel tab assembly 30 may accordingly be varied to accommodate different bag sizes and bag ply thicknesses, strengths and the like, as would be understood by those skilled in the bag-making industry.

The perforations 35 facilitating the tamper evident function have a spacing that corresponds to the spacing of the slits S to be co-linear therewith when placed on the front wall 11, as in FIG. 12. Portions of the assemblies 30 at references T and TT are marginal edges of the tamper evident cover ply 48 of the tamper evident lamina 34 shown in FIGS. 8 and 9. The portions T and TT would remain on the front wall 11 as the first portion I is lifted upwardly from second portion II, separating the assembly 30, and forming the tears 21 and 21' as the pinched closure 19 is tom during the opening of the bag 10.

Figure 8A:
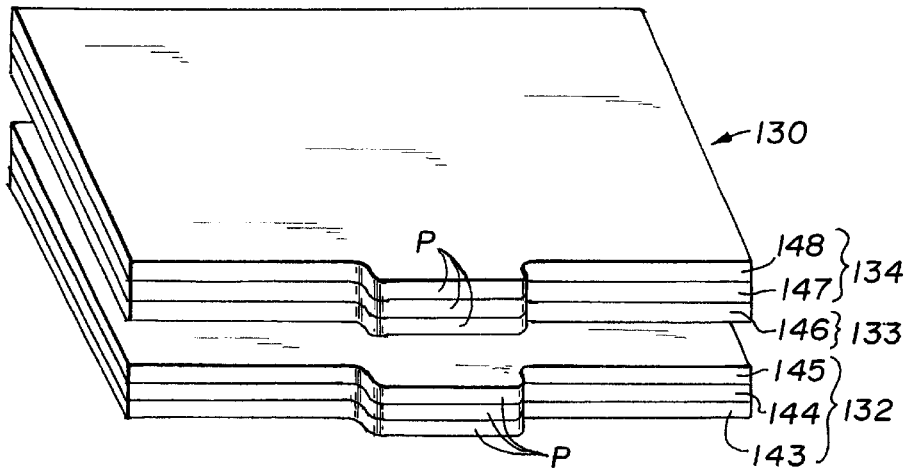
FIG. 8A is a perspective exploded view substantially like the view of FIG. 8 but showing an alternate embodiment of the peelable tab assembly of the invention eliminating a tamper evident layer and an adhesive bonding layer therefor, and further including g the peel-up flap as shown in phantom in FIGS. 10/10A and 11/11A.
Figure 9A:
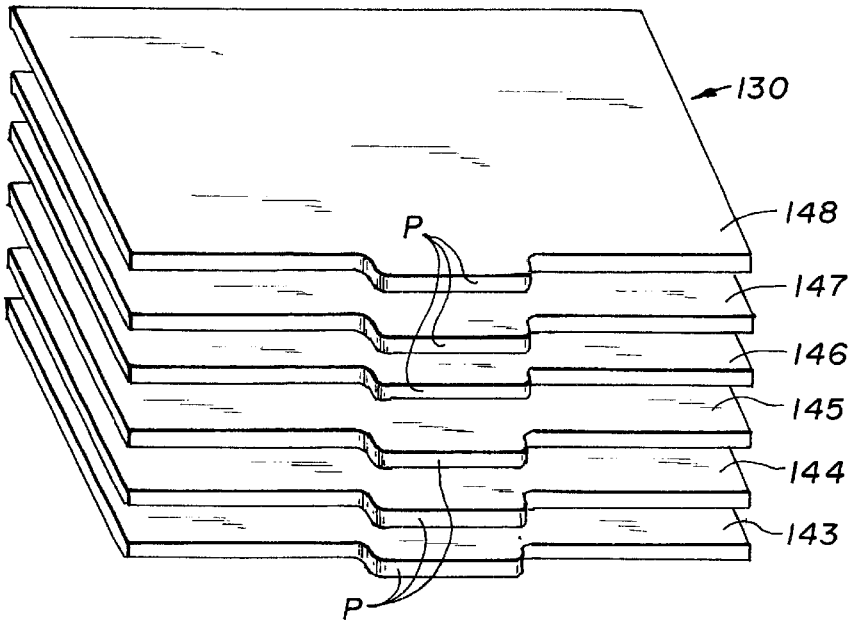
FIG. 9A is a perspective exploded detail view of the multi-layers of the alternate embodiment for the peel tab assembly as in FIG. 8A showing, for purposes of explanation, three layers of adhesive and three laminae forming the alternate embodiment of the peel tab assembly.

FIGS. 8A, 9A, 10/10A, 11/11A, 12A–18A, illustrate an alternate preferred embodiment of the invention at peel tab assembly 130. For ease of reference, reference numerals to the multiwall bag 10 correspond and identify the same elements as in the embodiment for the assembly 30 with respect to FIGS. 1–18 and the reference numerals for the elements of the peel tab assembly 130 correspond to the elements of the peel tab assembly 30 with the addition of the preceding numeral "1". The peel tab assembly 130 provides an alternate wherein the layer 148 is a modification of tamper evident layer 48 to eliminate the tamper evident feature and wherein the peel tab assembly 130 eliminates a base lamina and accordingly there is no lamina in the peel tab assembly 130 corresponding to the base lamina 31. In reference to FIGS. 8A and 9A, it will be seen that the peel tab assembly 130 is provided to have a bonding lamina 132 made up of a permanent adhesive layer 143 bonding a carrier ply 144 to the face of the front wall 11 and the carrier ply 144 is coated by a releasable adhesive layer 145. Accordingly, the bonding lamina 132 is provided to remain on the face of the bag front wall 11 upon the peelable opening of the peel tab assembly 130. Overlying the bonding lamina 132 is a peelable lift lamina 133 comprised of a single ply 146 comprising a 5 mil thick polyolefin ply in the disclosed embodiment. Other suitable materials, including 1–5 mil thick polyesters, polypropylene, or polystyrene films, and equivalents, may be used. Thus, the lift lamina 133 is the peelable component for separation from the bonding lamina 132. In yet another alternative embodiment, and similar to the equivalent modification to the tab assembly 30, the releasable adhesive layer 145 may be coated onto the lift lamina 133 to be carried upwardly by the lift lamina 133 and not stay on the face of the front wall 11, which would be useable in those types of bagged products where all of the contents of the bag 10 are dispensed in a single serving and the potential for granules to stick to the adhesive is not important. The adhesive 145 could be, but need not be, re-adherable in this alter ate. In the disclosed embodiment the ply 146 is a clear plastic material comprising the peelable if the lamina 133 and is adhered to an uppermost lamina 134 comprised of a permanent adhesive 147, for bonding it to the lift lamina 133, and an upper ply 148, which in the disclosed embodiment comprises a 50 lb white, uncoated litho paper, that can receive printed indicia, such as advertising, instructions, trademarks, and the like.

The peel tab assembly 130 is further characterized by providing peel-up flaps P on the constituent layers 143–148 facilitating the finger-opening of the peel tab assembly 130 by the placement of a consumer's fingernail between the lift lamina 133 and the bonding lamina 132, as generally shown in FIG. 8A. Thus, it will be seen that the lift lamina 133 and the uppermost lamina 134 are peeled away from the bonding lamina 132.

The permanent adhesive 143 is preferably a general purpose permanent adhesive, such as a hot melt rubber based adhesive or other equivalently performing adhesives, including acrylics and solvent based adhesives. The permanent adhesive 143 can be applied preferably in a coating weight of from about 11–15 lbs per 3,000 square feet. It will generally have a minimum application temperature of 40° F. and a service temperature of from −50° F. to 150° F.

The plastic material comprising the carrier ply 144 is preferably a clear polyester having a thickness range of about 1–2 mils and may alternately comprise other polyolefins, polypropylene or polystyrene film. In the preferred embodiment, the carrier ply 144 is 1 mil thick and has a tensile machine-direction strength of 30,000 psi and a machine-direction elongation of 130% and cross-direction elongation at break of 50%.

The peelable adhesive 145 in the preferred embodiment is a hot melt rubber based adhesive that is coated in the range from about 13–17 lbs per 3,000 sq. ft. It has a minimum application temperature of 40° F. and a service temperature in the range of from −50° F. to 150° F.

The peelable ply 146 comprising the lift lamina 133 in the preferred embodiment is a 5 mil clear polyolefin tag stock. Alternate materials include polyesters, polypropyllenes and polystyrene films which, as with the carrier ply layer 144, may be provided in a thickness in the range of from about 1–5 mils.

In the illustrative embodiment shown in the figures, the permanent adhesive 147 for bonding the lift lamina 133 to the uppermost ply 148 is a hot melt rubber based adhesive that is coated in the range from about 8–12 lbs. per 3,000 sq.ft. and has a minimum application temperature of 40° F. and a service temperature of from −50° F. to 150° F. Equivalently performing acrylics or solvent based adhesives may also be used as noted above.

The uppermost ply 148 comprising the upper lamina 134 in the disclosed embodiment is 50–80 lb. semi-gloss bleached kraft paper coated on one or two sides. In a preferred mode, utilizing an 80 lb semi-gloss kraft paper, the paper has a thickness of 4.8 mils and a machine-direction tear strength of 83 grams and cross-direction tear strength of 91 grams. The machine-direction tensile strength is 46 lbs per inch and the cross-direction tensile strength is 22 lbs per inch. However, a wide range of equivalents can be used. A suitable alternative is 50 lb. white uncoated litho paper. As noted for the embodiment comprising the peel tab assembly 30, having the uppermost ply 48, the uppermost ply 148 of the assembly 130 need not be limited to paper stock, but might also be woven fabric, metal foil, or plastic, such as polyester, polyethylene, polystyrene, polypropylene, or other suitable polyolefins, which material selection depends upon the requirements of the bag manufacturer particularly with respect to providing printed indicia and the like on this upper visible ply of the peel tab assembly 130.

Turning now to FIGS. 10/10A and 11/11A, it will be understood that the no options 10A and 11A refer to the peel tab assembly 130 having consumer-friendly pull-up flaps P, shown in phantom lines, whereas the peel tab assembly 30 is rectangular and most readily peelable at its corners (FIG. 12). Otherwise, the views in FIGS. 10 and 10A and 11 and 11A are visually identical with respect to the way the peel tab assemblies 30 and 130 are attached to the multiwall bag 10.

Figure 13A:
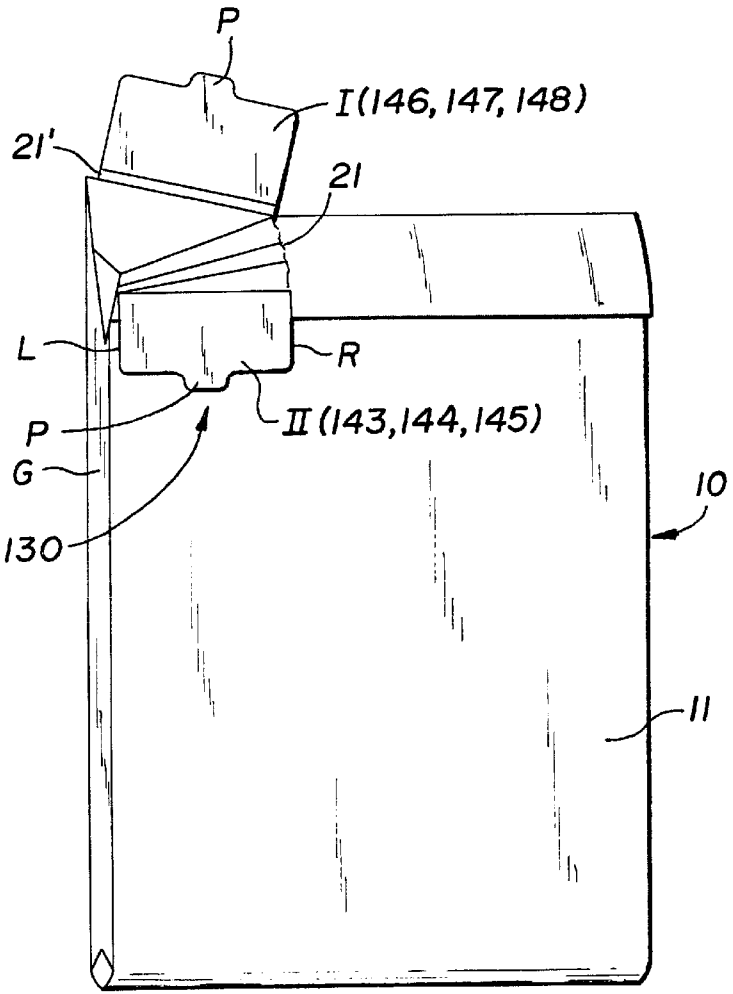
FIG. 13A is a perspective view of the gussetted multiwall bag tube as in FIG. 12A showing the completed peel opening of the alternate embodiment of the peel tab assembly whereby the first portion tears open the back wall of the bag and opens the bag to form a pour spout thereat for dispensing a product.
Figure 12A:
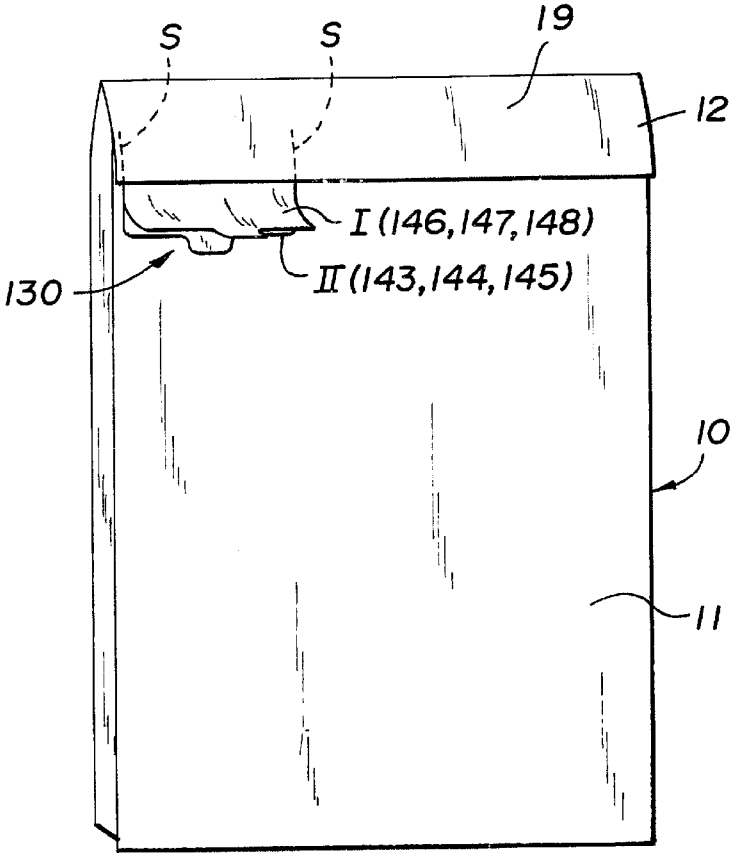
FIG. 12A is a perspective view of a gussetted multiwall bag tube including the alternate embodiment of FIGS. 8A and 9A, and as shown in part by the phantom lines in FIGS. 10/10A and 11/11A, illustrating the initiation of the peel opening of the peel tab assembly whereby to peel a first portion away from a second portion remaining on the front wall face of the bag.

FIG. 12A shows the peeling up of the lamina 133 and 134 comprising the layers 146, 147 and 148. Roman numeral I indicates this lift-up portion of the peel tab assembly 130 while Roman numeral II indicates the bonding lamina 132 comprising the layers 143, 144 and 145 that remain on the face of the front 11 of the bag 10. FIG. 13A shows the fully open peel tab assembly 130 made possible by the consumer inserting a fingernail at the peel-up flaps P to separate the peel-up portion I from the stay-down portion II. As with the peel tab assembly 30, the peel tab assembly 130 tears through the bag back wall 12 plies B along slits S to create tear lines 21 and 21' to open the bag 10. The slits S aid tearing the bag open and are preferably made only through the inner plastic liner and innermost paper ply for a small portion thereof as shown in dashed lines at FIG. 12A.

FIG. 14A shows the resealability of the peel tab assembly 130 to reclose the bag 10 following a dispensing of a portion of the product from within the bag 10.

Figure 10A:
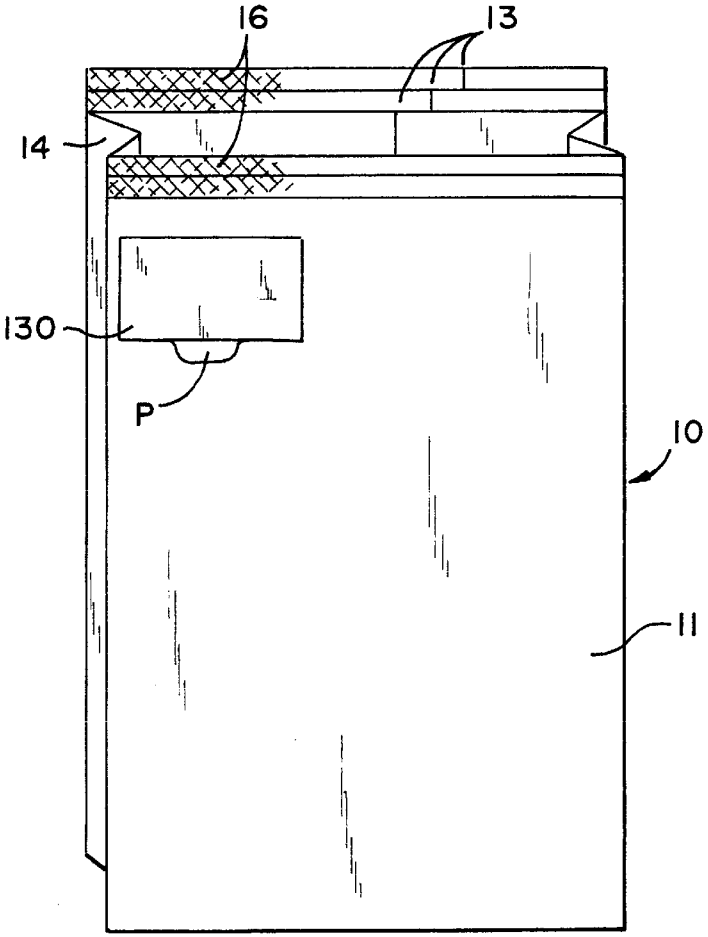
Figure 15A:
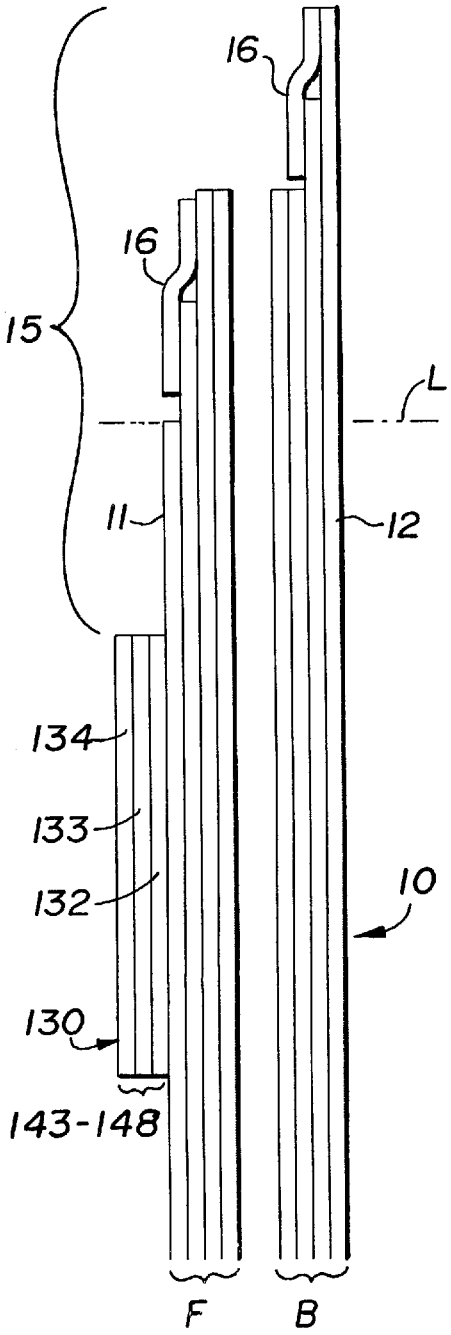
FIG. 15A is a vertical section taken through the alternate peel tab assembly arranged with the gusseted multiwall bag tube in the condition as shown in FIGS. 10/10A and showing the pinched closeable open end, the multi-ply front and back walls of the bag, and the alternate embodiment of the peel tab assembly being adhered to the face of the front wall.
Figure 16A:
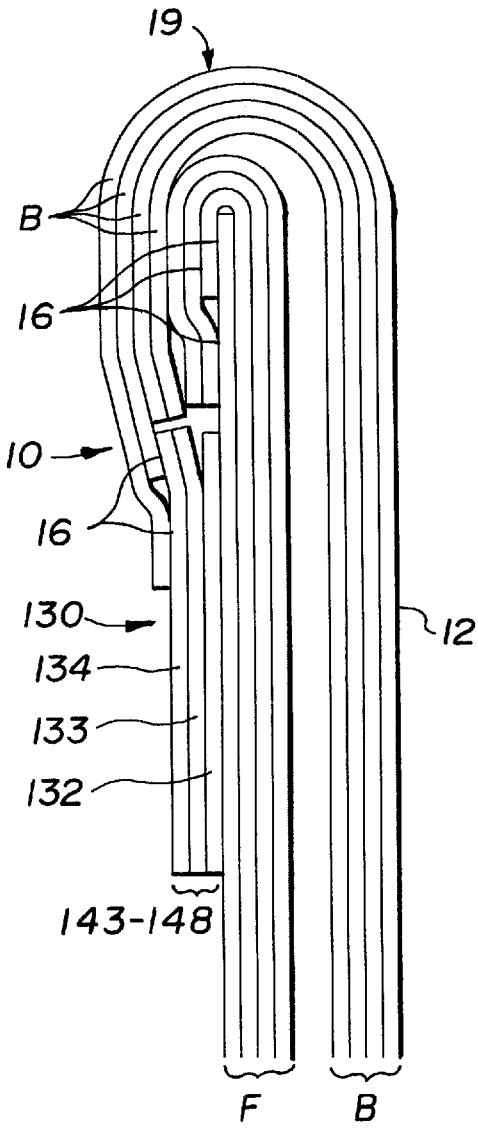
FIG. 16A is a vertical section taken through the alternate peel tab assembly as in FIGS. 11/11A and illustrating the retention of the first section of the peel tab assembly at the pinched closure by means of being overlain by and adhered to the folded-over back wall of the gusseted multiwall bag tube.

FIG. 15A is a cross sectional view of the peel tab assembly 130 mounted on the face of the front wall 11 of the bag 10, corresponding to the view shown in FIG. 10A, where the peel tab assembly 130 has been placed by the manufacturer on the front wall 11 when the bag tube is formed. FIG. 15A also shows the adhesive 16 on the front wall 11 plies F and the back wall 12 plies B for sealing closed the pinch closure, wherein the adhesive 16 on the back wall plies B would be folded over to seal against the peel tab assembly 130 at section 130*a* (FIG. 17A) and the adhesive 16 on the front wall plies F would be used to adhere the upper ends of the front plies F together in the folded-over condition as shown in FIG. 16A. The fold closure, in the nature of a pinch closure generally referenced at 19, is made by pivoting the bag walls around the fold line L.

Accordingly, as best viewed in FIG. 16A, in the preferred embodiment the peel tab assembly 130 is adhered to one or more of the plies F of the front wall 11 but not to the back wall 12 plies B. Thus, as with the peel tab assembly 30, the peel tab assembly 130 tears open the back wall plies B but leaves the front wall plies F intact. In an optional embodiment, a portion of the peel tab assemblies 30,130, and alternate embodiments thereof, might also be adhered to an outer ply of a bag front wall to lift and tear it open for use in a related but non-pinch closure type of folded-closed bag.

Figure 17A:
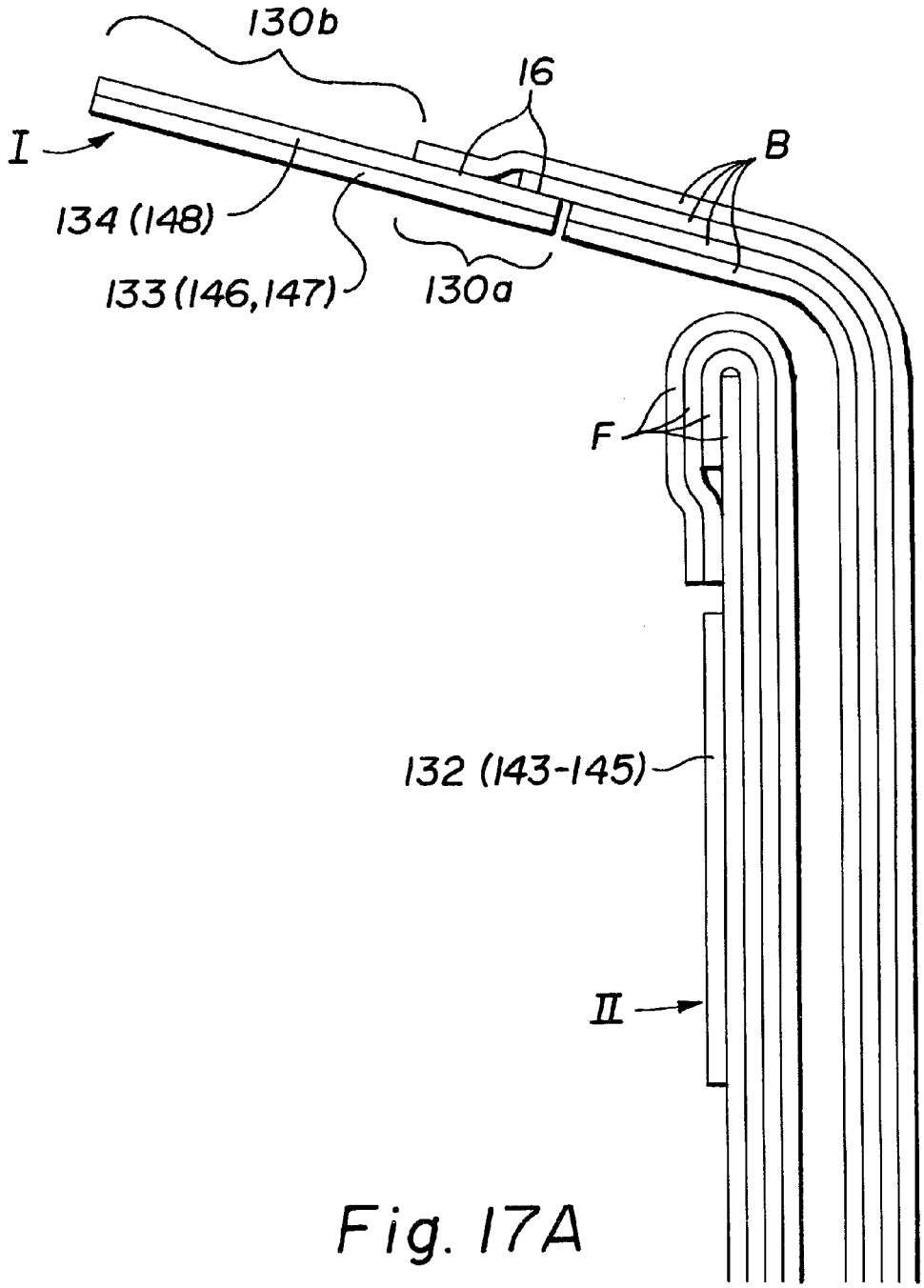
FIG. 17A is a vertical section taken through the alternate embodiment of the peel tab assembly in the open condition as shown in FIG. 13A and illustrating the peel away opening of the peel tab assembly as it opens the bag wherein the first portion of the peel tab assembly is lifted upwardly with a part of the back wall and the second portion is retained on She face of the front wall of the bag as in FIG. 13A.

FIG. 17A shows the bag 10 being open by the lifting of the portion from the portion 11 and also showing the section 130*a* adhered by the adhesive 16 to the back wall 12 and the extended second section 130*b* extending from the section 130*a*. The section 130*b* including a visibly apparent portion of the upper lamina 134 that might bear printed indicia, for example, instructions, advertising, and the like, thereon. FIG. 17A shows in section the relationship of the peel tab assembly 130 to the opened bag 10 shown in FIG. 13A.

Figure 18A:
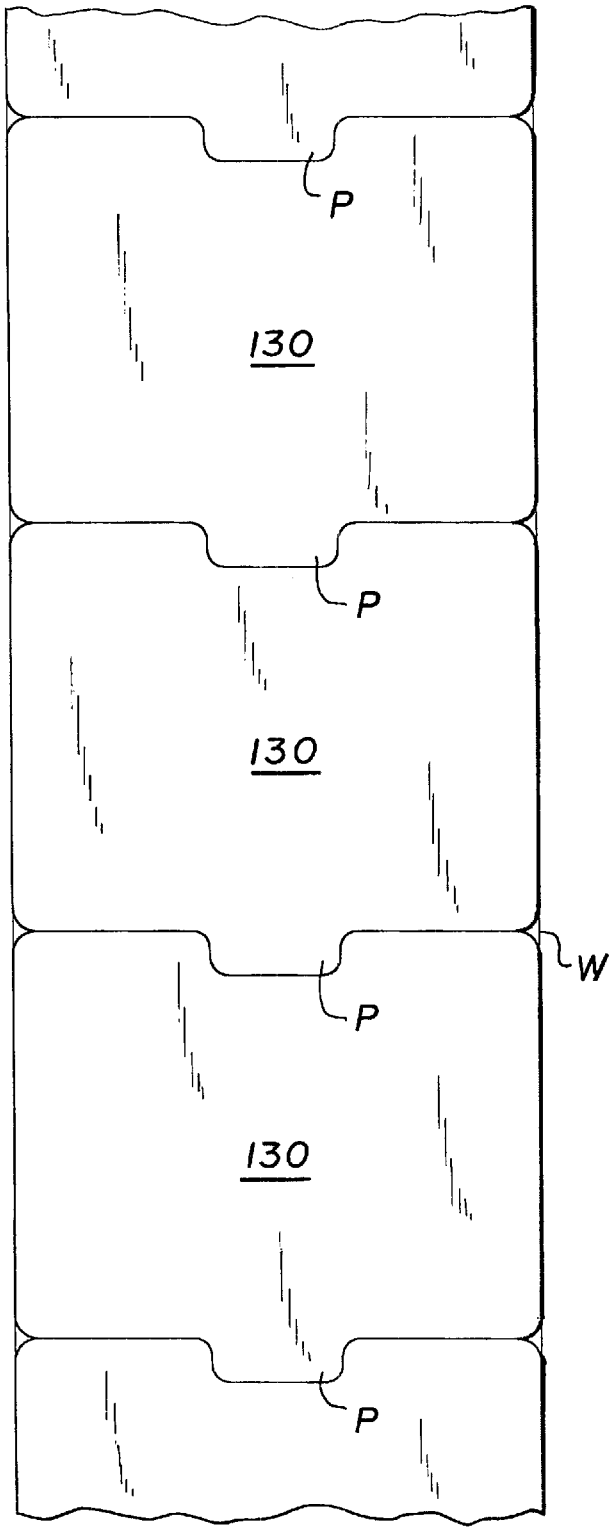
FIG. 18A is a plan view of a continuous release liner web of a plurality of the alternate of the peel tab assemblies as shown in FIGS. 8A–9A, and which peel tab assemblies are individually removed from the web and fed into bag forming equipment for placement on the front wall face of the bag as in FIGS. 10/10A during bag manufacturing.

FIG. 18A illustrates a sequence of separable peel tab assemblies 130 which could be made by a label manufacturer. The assemblies 130 are on a releasable liner comprising web W, which is typically a release-type paper, such as 40–50 lb. kraft stock, allowing the assemblies 130 to be removed to thereby expose the underside permanent adhesive layer 143, whereupon a bag manufacturer would then place the assemblies 130 on sequentially made bags in the position on the bags as shown in FIG. 10A during bag manufacturing. In the disclosed embodiment, the tab assembly 130 is three inches long and four inches in width across the face of the bag Typically, this size would be used for a typical multiwall bag, such as used for dog or cat food, which would contain a granulated product in the range of from about 10 to 20 pounds. Of course, the invention is not limited to any particular size bag and the length and width of the peel tab assembly 130 may accordingly be varied to accommodate different bag sizes and bag ply thicknesses, strengths and the like, as would be understood by those skilled in the bag-making industry.

In another embodiment of the invention, similar to an alternate to the peel tab assembly 30 as described in the foregoing, the peel tab assembly 130 can be downsized to consist of two components or layers wherein the lamina 132 would comprise only the releasable adhesive layer 145 and be overlain by the peel-up lift lamina 133 comprising only the peelable ply 146. Thereby the peel tab assembly 130 would comprise simply the adhesive layer 145 and the peel-up ply 146. The bag back wall plies B would overlie and adhere to the section 130*a* comprising an upper section of the peelable ply 146 and the section 130*b* extending therefrom would be an exposed face of the peelable ply 146 extending therefrom. Accordingly, the laminae 132 and 133 are each single component lamina in this embodiment.

Figure 20:
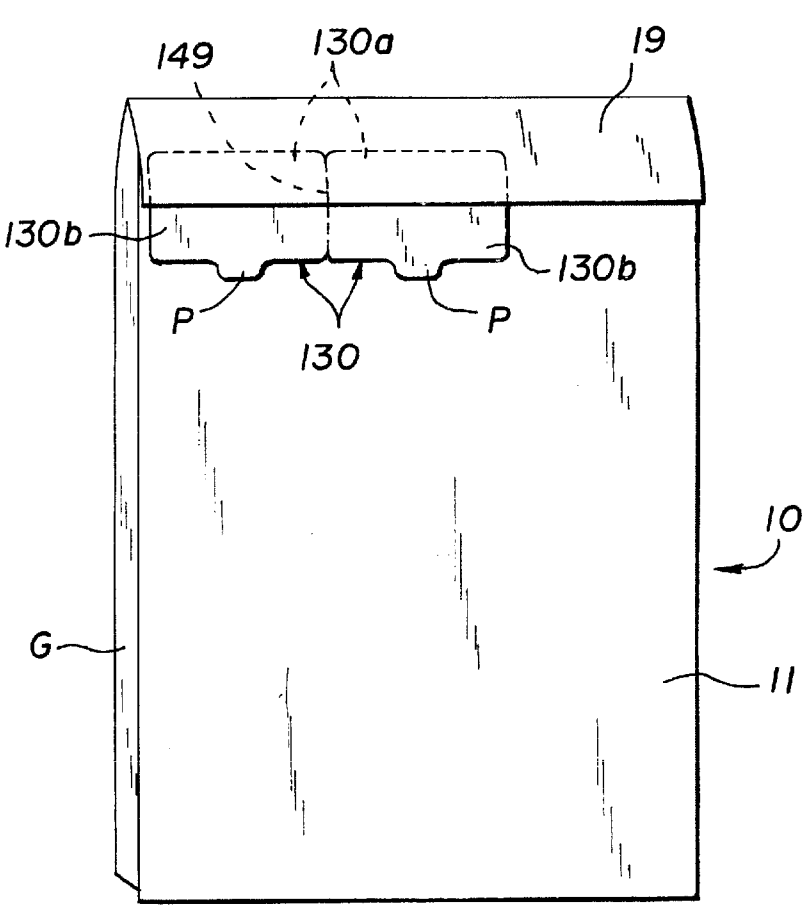
FIG. 20 shows a folded closed pinched closure of the bag 10 over the double tab assemblies as in FIG. 19 similar to the folded closed bag as shown in FIGS. 11/11A.
Figure 19:
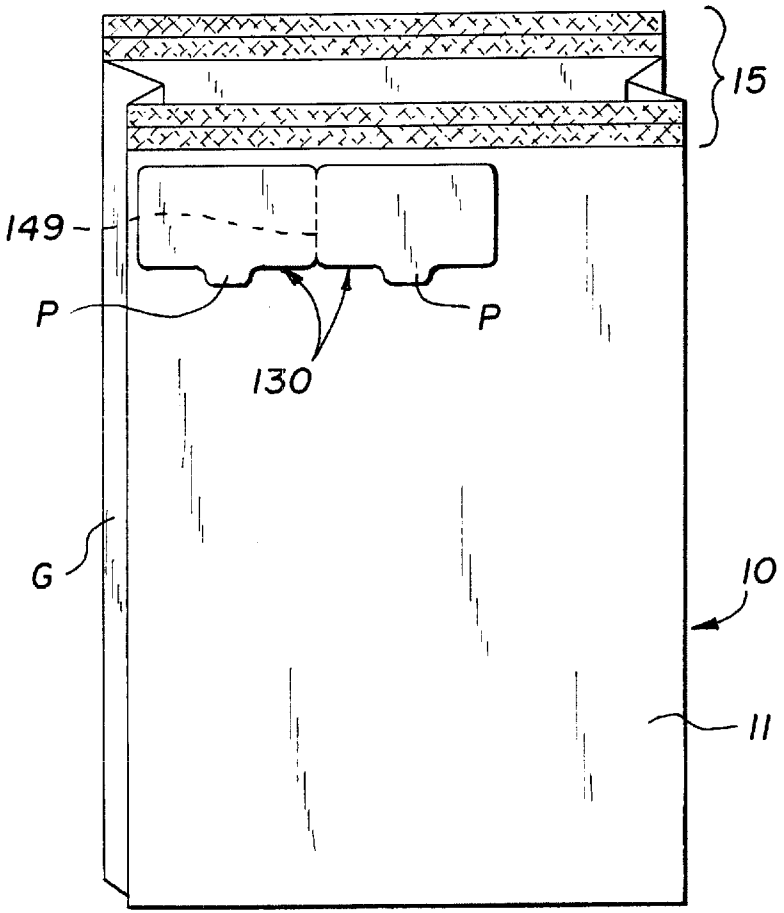
FIG. 19 is yet another alternate embodiment of the invention utilizing the 3 first alternate embodiment as in FIGS. 8A, 9A, 10/10A, 11/11A and 12A–18A, and further including a double-tab assembly with a rupturable serration therebetween for opening one or both of the peel tab assemblies.
Figure 21:
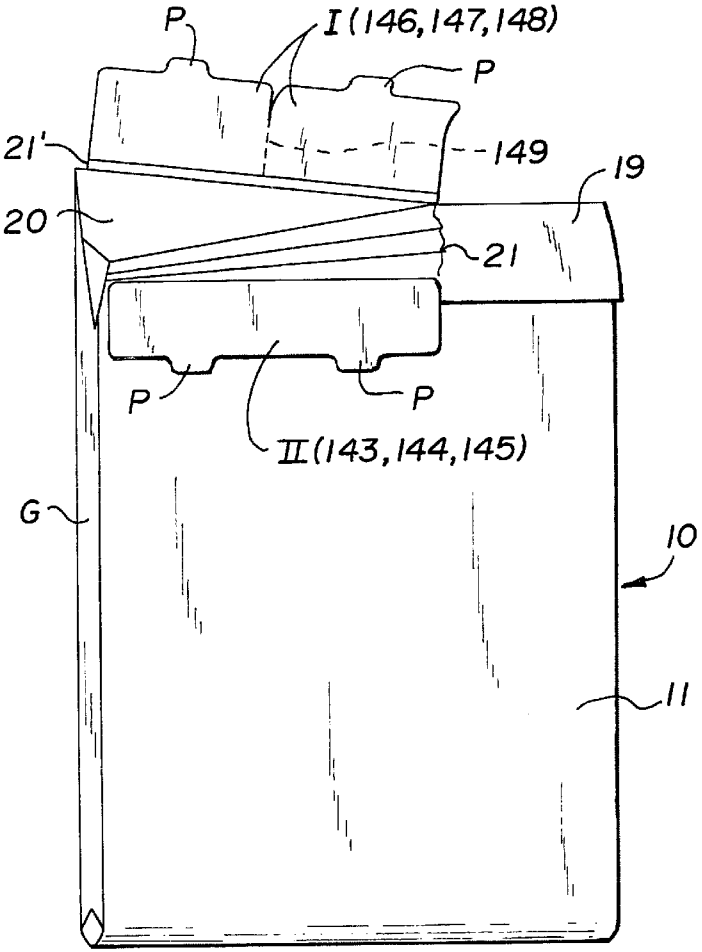
FIG. 21 illustrates the opening of the double-tab assemblies of FIGS. 19 and 20 showing the opening of both of the double peel tab assemblies, whereby to tear through the back wall of the bag and open the bag to form an opening, which may be selectively a single opening of one of the assemblies for forming a pour spout or the opening of both of the assemblies to facilitate the insertion of a scoop to scoop out the contents of the bag, wherein the first portion of the peel tab assemblies are peeled away from the second portions being retained on the front wall face of the bag.

With attention directed to FIGS. 19–21, the invention further includes an optional embodiment involving the provision of multiple peel tab assemblies for application to a bag 10 closeable in the manner of a pinch closure of stepped plies 15. Accordingly, there is provided two, or more, peel tab assemblies 130joined by a separable joinder line 149. As would be clear, the embodiment of the peel tab assembly 30 could similarly be provided to comprise multiple peel tab assemblies 30 similarly arranged with a bag 10.

The illustration of FIG. 19 shows the placement of two peel tab assemblies 130 on the face of the bag 10 similar to the step shown in FIGS. 10/10A. FIG. 20 shows the folded pinch closure 19 of the bag 10, wherein sections 130*a* are captured and adhesively bonded to the back wall 12 plies B of the bag 10 and sections 130*b* extend from the closed pinched closure 19 for gripping and lifting by the consumer at flaps P. FIG. 20 is similar to the bag closing step shown in FIGS. 11/11A.

FIG. 21 shows the opening of the bag 10 similar to FIGS. 13 and 13A, wherein a peelable portion I comprising layers 146, 147 and 148 are peelable away from the portion II comprising layers 143, 144, 145, which stay on the face of the bag 10.

The double peel tab assembly shown allows the consumer to open the peel tab assembly 130 closest to the side of the bag for forming the pour spout opening 20. The second peel tab assembly 130 may be contemporaneously, or subsequently, opened, whereby to provide a larger opening 20 into the bag 10. Such larger opening serves the purpose of allowing one to use a scoop to manually scoop product from the bag, rather than pouring. Thus, the tear lines 21 and 21' caused by tearing open both peel tube assemblies 130 are farther apart and define a larger opening 20 therebetween.

It will be understood that the joinder line of separation 149 need only constitute a serration, perforation, or weakened line, through the layers 146, 147 and 148 comprising portion(s) I, because the portion(s) II remains on the face of the bag and does not need to be separated. Accordingly, the embodiment depicted in FIG. 21 does not include a line of separation on portions II. However, due to manufacturing requirements, it may be necessary to serrate or die cut the line of separation 149 through all of the laminae 143–148 for ease of manufacture and to ensure that 146–148 are cut through.

The foregoing is a description of the preferred alternate embodiments for the invention but the claims appended hereto will be understood to have a broader scope than the illustrative embodiments shown and encompass a wide range of equivalency.

What is claimed is:

1. An integral peel tab assembly having an internal non-removable non-adhesive layer releasably secured by a non-removable tacky adhesive providing an opening mechanism for a multiwall bag, the peel tab assembly requiring only the removal therefrom of an external adhesive-covering release layer to permanently adhere the peel tab assembly to a bag surface comprising:

a removable external release layer;

a first permanent adhesive layer covered at a first surface thereof by said removable external release layer for removal from said first permanent adhesive layer to make said first permanent adhesive layer an external layer for adhering said peel tab assembly to a bag wall:

a carrier layer adhered at one surface to a second surface of said adhesive layer;

a non-removable tacky releasable adhesive at a second surface of said carrier layer;

a non-tacky, non-adhesive internal release layer releasably and re-securably adhered at a first surface thereof to said tacky releasable adhesive, wherein the internal release layer is non-removable from the peel tab assembly;

a second permanent adhesive layer being an internal layer and arranged on a second surface of said internal release layer;

an outer layer adhered to said internal second permanent adhesive layer;

wherein, said peel tab assembly capable of being positioned to have a section thereof folded within a foldable closure end of a multiwall bag and having sufficient length to provide a second section thereof extending away from a said foldable closure end, said internal release layer being non-removable from the peel tab assembly and being repeatedly releasable from said non-removable tacky adhesive to open a foldable bag closure and repeatedly re-securable to close a foldable bag closure.

2. The peel tab assembly of claim 1 wherein said first permanent adhesive layer is a hot melt permanent adhesive.

3. The peel tab assembly as claimed in claim 1 wherein said carrier layer is a clear plastic.

4. The peel tab assembly as claimed in claim 1 wherein said second permanent adhesive layer is a hot melt permanent adhesive.

5. The peel tab assembly as claimed in claim 1 wherein said outer layer comprises a paper capable of receiving printed indicia thereon.

6. A multiwall paper bag having at least one end closed in the manner of a p inch folded closure of first and second bag walls, and said end having a laminated member for tearing open a portion of the second bag wall and being positioned between a portion of the first of said bag walls at the pinch folded closure and the second said bag wall, said laminated member having one lamina thereof permanently adhered only to said tear openable portion of the second bag wall, and another lamina thereof permanently adhered only to the first of said bag walls at said pinch folded closure, the laminated member laminae being adapted to be separated, and wherein said lamina adhered to said first bag wall having a releasable tacky adhesive surface for releasably bonding said laminae together and thereby reclosing the tear-openable portion of the second bag wall into substantially the same position as before being torn open.

7. A separable multi-laminate permanently attached to walls of a fold-closable bag end and positioned between front and back walls of a fold-closable bag end and having sufficient length to have a section extending from said fold-closable bag end and capable of being gripped by human fingers to tear open one of said bag walls, said multi-laminate comprising:

an adhesive tacky target layer having a releasable adhesive capability at a face thereof and being permanently attached to said bag front wall to extend away from said fold-closable bag end; and, a non-tacky non-removable releasable layer permanently attached to said bag back wall and movable with a tear-openable portion of said bag back wall, said non-removable releasable layer being releasably adhered to said face of said adhesive tacky target layer whereby to be peelable therefrom and remain movably attached to said tear-openable portion of said bag back wall.

8. The multi-laminate as claimed in claim 7 wherein said face of said adhesive tacky target layer remains tackified and capable of subsequent re-adherable association with said non-tacky releasable layer following a peelable separation therefrom.

* * * * *